United States Patent [19]

Matt

[11] Patent Number: 4,525,977

[45] Date of Patent: Jul. 2, 1985

[54] WRAPPING MACHINE AND METHOD

[75] Inventor: Timothy S. Matt, Bay Village, Ohio

[73] Assignee: Doboy Packaging Machinery, Inc., New Richmond, Wis.

[21] Appl. No.: 494,126

[22] Filed: May 13, 1983

[51] Int. Cl.[3] ..... B65B 9/06; B65B 57/00

[52] U.S. Cl. ..... 53/55; 53/77; 53/450; 53/550

[58] Field of Search ..... 53/55, 450, 451, 550, 53/551, 552, 562, 52, 64, 77

[56] References Cited

U.S. PATENT DOCUMENTS

| | | | |
|---|---|---|---|
| 3,445,981 | 5/1969 | Hori | 53/450 |
| 3,958,390 | 5/1976 | Pringle, Jr. et al. | 53/450 X |
| 4,106,262 | 8/1978 | Aterianus | 53/450 |
| 4,183,193 | 1/1980 | Klingelhofer et al. | 53/550 X |
| 4,299,095 | 11/1981 | Gram | 53/550 |

*Primary Examiner*—James F. Coan

*Attorney, Agent, or Firm*—Orrin M. Haugen; Thomas J. Nikolai; Douglas L. Tschida

[57] ABSTRACT

A horizontal wrapping machine which includes a former for shaping a continuous film of packaging material drawn past the former into a continuous tube, a film drive for drawing the continuous film of packaging material past the former and past a cutting and sealing station, a product infeed drive for feeding products to be packaged through the former into the continuous tube of packaging material so that the products are spaced apart from one another in the tube, and a pair of motor-driven cut-heads at the cutting and sealing station for cutting and sealing the continuous tube of packaging material as each product moves past the cutting and sealing station. The horizontal wrapping machine further includes independent closed loop servo control circuits for the film drive, product infeed drive, and cut-head drive, each of which are responsive to a desired velocity control signal. The wrapping machine includes a first encoder on the shaft of a roller driven by the moving film, a second encoder coupled to the product infeed drive, and a resolver coupled to the cut-head drive. A microprocessor-based controller is coupled to the encoders, the resolver, and the servo loops for the infeed, film feed, and cut-head drives.

7 Claims, 23 Drawing Figures

MISSED EYESPOT INTERRUPT ROUTINE

SPLICER INTERRUPT ROUTINE

SET-UP ROUTINE

INFEED INTERRUPT ROUTINE

FILM FEED INTERRUPT ROUTINE

TIMED INTERRUPT ROUTINE

PRODUCT POSITION INTERRUPT ROUTINE

CUT HEAD PHASE CHANGE INTERRUPT

TEMPERATURE INTERRUPT ROUTINE

MAX. DWELL

WRAPPING MACHINE AND METHOD

DESCRIPTION OF THE INVENTION

This invention relates generally to wrapping and packaging machines and more particularly concerns a horizontal wrapping machine utilizing a control system and method wherein separate drives in the wrapping machine are independently servo controlled.

In a horizontal wrapping machine, a continuous film of packaging material is supplied from a roll and drawn past a former which shapes the film into a continuous tube of packaging material. Products to be wrapped are supplied through the former into the tube of packaging material such that the products are spaced apart from one another in the tube. The tube of packaging material is then cut and sealed as each product, carried within the tube, passes a sealing and cutting station. In this way, an individual sealed package is produced for each product from the continuous roll of packaging film.

Typically, the products to be packaged are supplied to the former on an infeed conveyor having a number of product pushers. Each adjacent pair of pushers defines an infeed conveyor flight, and each product is advanced to the former in an individual conveyor flight. As each product is advanced into the film former, it is picked up by the bottom surface of the interior of the now-formed film tube and carried in the tube to the cutting and sealing station.

The film is formed in the former such that the lateral edges of the film, when the tube is formed, extend downwardly from the center of the film tube in a side-by-side relationship. A number of pairs of finwheels rotating about vertical axes in a finwheel assembly engage opposite sides of the downwardly extending pair of film edges to drive the film toward the cutting and sealing station. At least one pair of finwheels in the finwheel assembly is heated, serving to heat seal the downwardly extending film edges together to seal the tube of film.

As the now-enclosed tube of film, carrying products spaced-apart from one another, advances past the sealing and cutting station, a pair of opposed cut-heads are rotated into engagement with the film tube between each successive pair of products. The cut-heads carry a cutting blade extending transversely to the film tube and are also heated so as to seal the film as well as cut it to thereby form individual sealed packages, each containing a now-wrapped product.

In the past, a typical horizontal wrapping machine has been driven by a single motor through a single line shaft. In such a wrapping machine, separate gear boxes and chain and sprocket drives are coupled to the main shaft for the infeed conveyor, the finwheel assembly, and the cut-heads.

There are a number of disadvantages associated with such prior art horizontal wrapping machines which are overcome by the horizontal wrapper disclosed in the present application. For example, in such prior horizontal wrapping machines, in order to change the length between cuts of the tube of film, which is defined as the cut length for each package, it is necessary to change a number of gears, pulleys and cams. In the present wrapping machine, a change in cut length may be effected in a short period of time without the necessity of changing parts. Since parts changes are not required with the present wrapping machine, there is no need to maintain a costly inventory of different sets of cams, gears and pulleys for each different cut length to be employed by the machine.

In prior art horizontal wrappers, it is also impossible to reverse the direction of rotation of the drive gears in order to operate one or more of the drives in the reverse direction. A typical prior machine used an epicycle for controlling the velocity of the cut-head, which cannot be driven in reverse. In the presently disclosed horizontal wrapping machine, such reverse operation of different drives in the machine is possible.

Also in prior horizontal wrappers, different sections of the machine cannot be operated independently of other sections without the use of mechanical clutches. Such independent operation is desirable during servicing of the machine in order to isolate problems in machine operation. In the present horizontal wrapper, different sections of the wrapping machine can be driven separately.

Another problem with prior horizontal wrapping machines is a difficulty in reorienting the phasing of the cut-heads relative to the desired cut locations between the products in the tube of packaging material. In the past, it has not been possible to vary the return velocity of the cut-heads when moving the cut-heads from the end of one cutting and sealing operation to a position to begin the next cutting and sealing operation. In the past, it has been necessary to stop the wrapping machine and reorient the angular position of each cut-head relative to the film cut position. In the presently disclosed horizontal wrapping machine, the return velocity of the cut-heads can be adjusted to advance or retard the cut-heads relative to the desired cut location.

In addition, in prior horizontal wrappers, it has not been possible to readily vary the product pusher position relative to the film position in order to correct product registration errors. In the past, it has been necessary to stop the wrapping machine and disengage a mechanical clutch between the main drive and the pusher drive while reorienting the pusher chain relative to the main drive. In the presently disclosed horizontal wrapper, it is possible to sense the pusher location relative to the film position and advance or retard the pusher by adjusting the infeed conveyor velocity.

A related problem in the past has been an inability to change the product-to-film registration during operation of the machine. In the past, it has been necessary to stop the machine and adjust the pusher position relative to the main drive. In the present system, the product registration can be changed using operator accessible inputs during the operation of the machine.

Similarly, in the past, it has been impossible to change the film-to-cut-head orientation during the operation of the machine. It has been necessary to stop the wrapping machine and physically rotate the cut-heads in order to obtain the desired orientation. In the present horizontal wrapping machine, it is possible through an operator-available input to vary the film-to-cut-head orientation during operation of the machine.

In order to obtain the above-mentioned advantages of the presently disclosed horizontal wrapping machine, the present wrapper includes three separate closed loop servo-controlled motor drives for the infeed conveyor, for the finwheel assembly which drives the film, and for the cut-head drive, respectively. Each closed loop servo control circuit includes a motor which is driven by a summer-amplifier. The summer-amplifier receives as a feedback signal the actual motor velocity and receives as a control signal a desired motor velocity.

Each servo control circuit is thereby operable to maintain its associated motor at the velocity established by the desired velocity control signal. Each of the servo control circuits forms a part of a microprocessor-based controller which coordinates the motor speeds to effect the desired synchronous operation of the horizontal wrapping machine.

In order to produce an acceptable packaged product, it is necessary, within selected tolerances, for the package to contain a certain desired length of film and for the product to be at a desired location relative to the length of film, which is formed into a completed package. There is an additional positioning requirement which arises typically due to the provision of printed material on the packaging film. This requirement is that each length of film used to form a package should have thereon the properly-oriented printed matter for the package.

Thus, for example, if the product to be packaged is a candy bar having a length of two and one half inches, it may be desired to package the candy bar in a package having a length of packaging film of four inches. It may further be desired to center the candy bar in the package. The length of film used for the package, four inches, is the cut length of the package. The length of the candy bar, two and one half inches, is designated the product length. Thus, for each four inch cut length of packaging film, it is desired to have a candy bar centrally located therein. This meets the above-mentioned first two requirements of proper centering of the product in the package and of proper package length.

Typically, a candy bar wrapper contains printed matter including the name of the candy bar and its manufacturer, and perhaps a list of ingredients, etc. The name is typically in large letters extending across most of the length of the product. In order for the product name to be properly located on each package, not only must the package length be approximately equal to the desired cut length, but also the positioning of the product relative to the printed matter must be approximately correct so that the product name lies on the product and not across a cut location on the film.

In the usual case, marks are placed on the film, such as along one of the film edges, to mark the beginning and end of each cut length. It is therefore desirable that as each such indicated cut length of film moves past the film former that one product be placed in the film tube at the desired location relative to the beginning and the end of the cut length. Where each cut length is defined as beginning at a film mark, termed an eye spot, the distance along the film tube from the eye spot to the front edge of the product is termed the product registration. Thus, in the above-mentioned example, if the two and one half inch candy bar is to be centered in each package, the desired product registration is three quarters of an inch. The term product orientation shall be referred to herein as the distance from the eye spot to the trailing end of the product. In the foregoing example, the product orientation is three and one quarter inches.

Not only must the proper product orientation relative to the marked film be obtained, but the sealing and cutting by the cut-heads must also occur between the products. The cut-heads will engage the film at locations centered about the eye spots if each product is properly oriented relative to each cut length of film.

In the horizontal wrapping machine illustrated herein, the master control for each of the servo motors is derived from the speed of the film moving through the machine. In the illustrated machine, a microprocessor-based controller monitors the actual film speed. Based upon this actual film speed, the controller outputs the desired product infeed conveyor speed to the infeed conveyor motor summer-amplifier and outputs the desired cut-head speed to the cut-head motor summer-amplifier.

In order to infeed one product per cut length of film, the desired infeed conveyor speed must be set to be a proportion of the film speed so that exactly one product is delivered to the film former for each cut length of film which passes the film former. In order to maintain proper product orientation relative to the film cut lengths, the controller varies the desired velocity signal supplied to the infeed conveyor servo loop to correct for errors in product orientation relative to the film.

The cut-heads may be viewed as operating in two modes. During a cut and seal mode, wherein the cut-heads are in contact with the film, the cut-heads, at their film-engaging faces, move at substantially the same rate as that of the film. When the cut-heads are not in contact with the film, during what is termed a return mode, the cut-heads must move at a different rate of speed, usually a higher rate, in order to be repositioned for the next cut and seal phase.

The controller supplies a desired cut-head velocity to the cut-head servo motor amplifier during a cut cycle to move the film-engaging cut-head faces at a rate substantially equal to the film speed. During a return cycle, the controller supplies a desired velocity signal to the cut-head summer-amplifier, which is derived from the film velocity, such that the cut-heads are in proper position for the next cut cycle.

In summary, the present horizontal wrapper, having a control arrangement as described, overcomes the above-enumerated disadvantages of prior, mechanically synchronized, horizontal wrapping machines. Since the drive motors for the different sections of the present horizontal wrapper are separately servo controlled, the different sections of the wrapper may be operated independently and may be operated in forward or in reverse. Due to the independent control of the cut-head drive, the return velocity of the cut-heads may be individually controlled. Likewise, the independent control of the product infeed conveyor motor permits variation of pusher position and product registration relative to film cut lengths.

There are a number of additional difficulties with prior art horizontal wrapping machines. The accuracy of such prior art machines is reduced since the total error of the entire gear train in a prior art machine is the sum of the errors of the individual gears. In the presently illustrated system, there is a closed servo loop for each function and therefore no cumulation of errors through the entire machine controller.

In addition, in prior horizontal wrappers, abrupt changes to correct orientation errors are not possible. For example, if the product orientation degrades due to film stretching, the error remains and is corrected only gradually, at best, as packages are produced by the machine. In prior horizontal wrappers, product orientation corrections are made by adjusting the film feed, based upon eye spot measurements on the film. If an attempt is made to adjust the film too rapidly, the film can be torn or broken. In the present system, the product infeed is adjusted in order to alter the product registration and this can be accomplished substantially instantaneously.

In a typical prior horizontal wrapper, it was not possible to add auxiliary functions, such as, for example, a card feeder for placing a card beneath each product introduced into the film former, without substantial machine redesign to link the auxiliary function drive to the main drive shaft of the machine in proper synchronization. In the present system, synchronous auxiliary devices can be added to the horizontal wrapper using an individual servo control with the synchronization derived electronically from the film travel. In addition, adding auxiliary functions in the present horizontal wrapper does not require resizing a main drive motor, since separate drive motors are used for the different functions.

Also in prior art wrappers, if product orientation is in error, and/or cut-head orientation is in error, there can be a collision between the cut-heads and the product. In the past, such collisions could not be sensed on a real time basis.

In the use of an automatic splicer on a wrapping machine, for example, a new roll of film is spliced onto the end of a previous roll to maintain continuous machine operation. In performing such splicing, the eye spots on the rolls of film generally are not in a correct position, or they may be omitted entirely from the leading or trailing edge of one of the film rolls. The prior horizontal wrappers were unable to recognize this condition, resulting in orientation errors and product-cut-head collisions.

In the present wrapping machine, the controller determines the product orientation relative to the cut length to establish, if possible within acceptable tolerances, a desired cut point, which may differ from the eye spot location. If the product orientations of two adjacent products are such that the products are too close together to permit the cutheads to seal and cut the film without a collision with a product, the controller aborts the cut in order to avoid a product collision.

In the past, when using film lacking eye spots to mark the cut lengths, it has been impossible to change the cut length without a complete change of gears, and other parts, in the wrapping machine. With the present horizontal wrapper, it is possible to change the cut length during operation, and the controller adjusts the cut-head velocities as necessary to accommodate the change.

Utilizing the present horizontal wrapping machine provides a number of additional advantages unavailable in prior art horizontal wrappers. In the present horizontal wrapper, a film travel indicator is utilized to determine the film speed in order to detect film breakage or overspeed conditions. In addition, controlled acceleration and deceleration of film speed is possible when film speed is changed. For example, if an operator-introduced product packaging rate is input to the machine controller, a controlled ramp-up of film velocity can be made in order to prevent tearing or breaking of the film. An immediate response when one parameter is varied is not required since there is not a single mechanical linkage connecting the various portions of the machine.

In horizontal wrappers, the sealing of the packaging film is effected by at least one heated pair of finwheels in the finwheel assembly and by the heated cut-heads. The heated finwheels seal the bottom of the package and the cut-heads seal the ends of the package. It is desirable to determine if the heat applied to the film is within a safe range. This may be accomplished by monitoring the time-temperature product of the heat applied to the film to see if it is within a safe band. This safe band of time-temperature product is a range of temperatures for a particular film speed at which the heating elements will neither burn the film nor fail to obtain a complete bonding of the film. In the present horizontal wrapper, the film rate is monitored, as well as the temperature of each heating element, and packaged products are rejected where the applied temperature is outside the acceptable range of temperatures for the film speed at which the machine is operated.

Other objects and advantages of the invention, and the manner of their implementation, will become apparent upon reading the following detailed description and upon reference to the drawings, in which.

Figure 1:
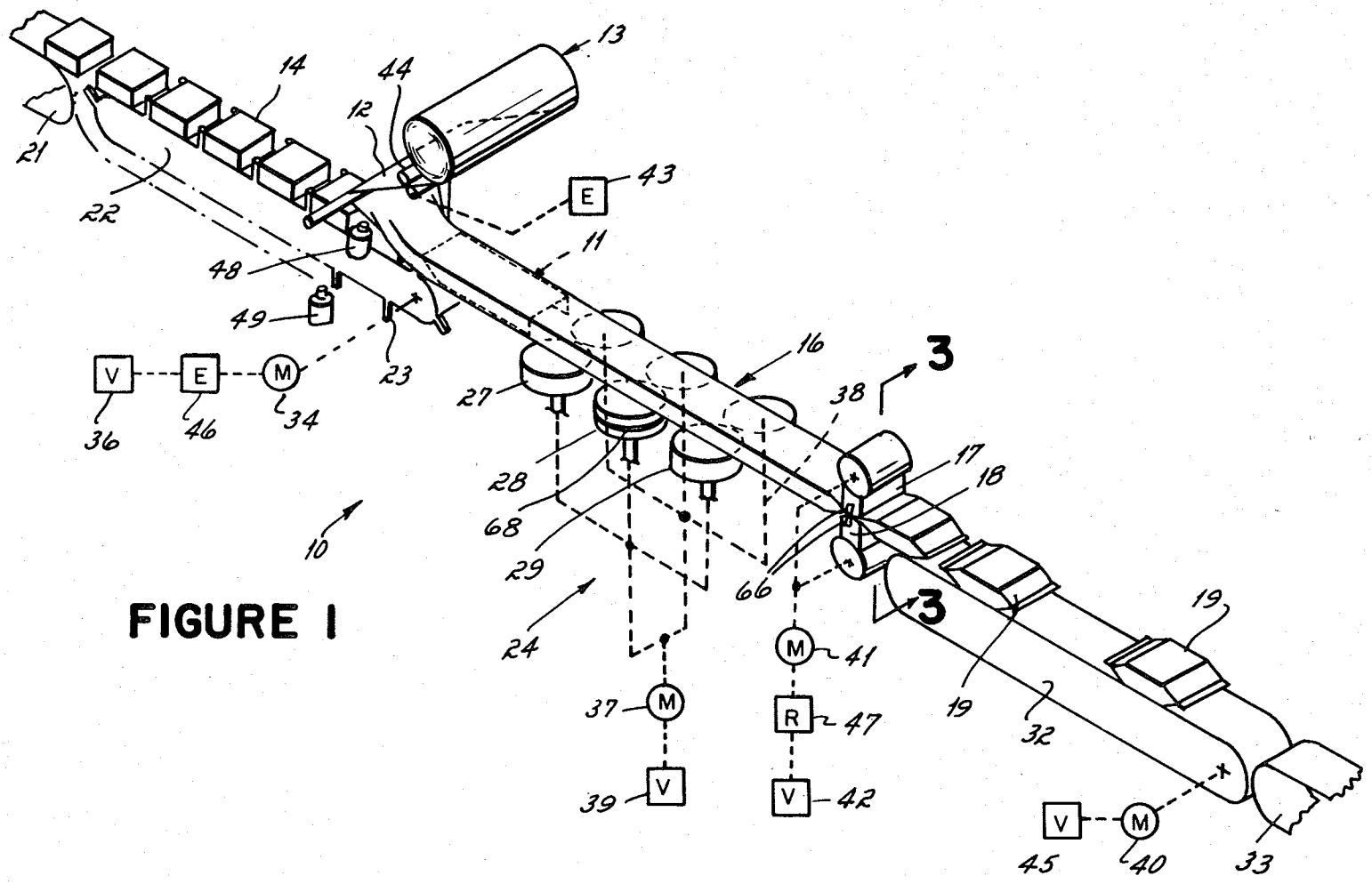
FIG. 1 is a diagrammatic perspective view of a horizontal wrapping machine in accordance with the present invention.
Figure 4:
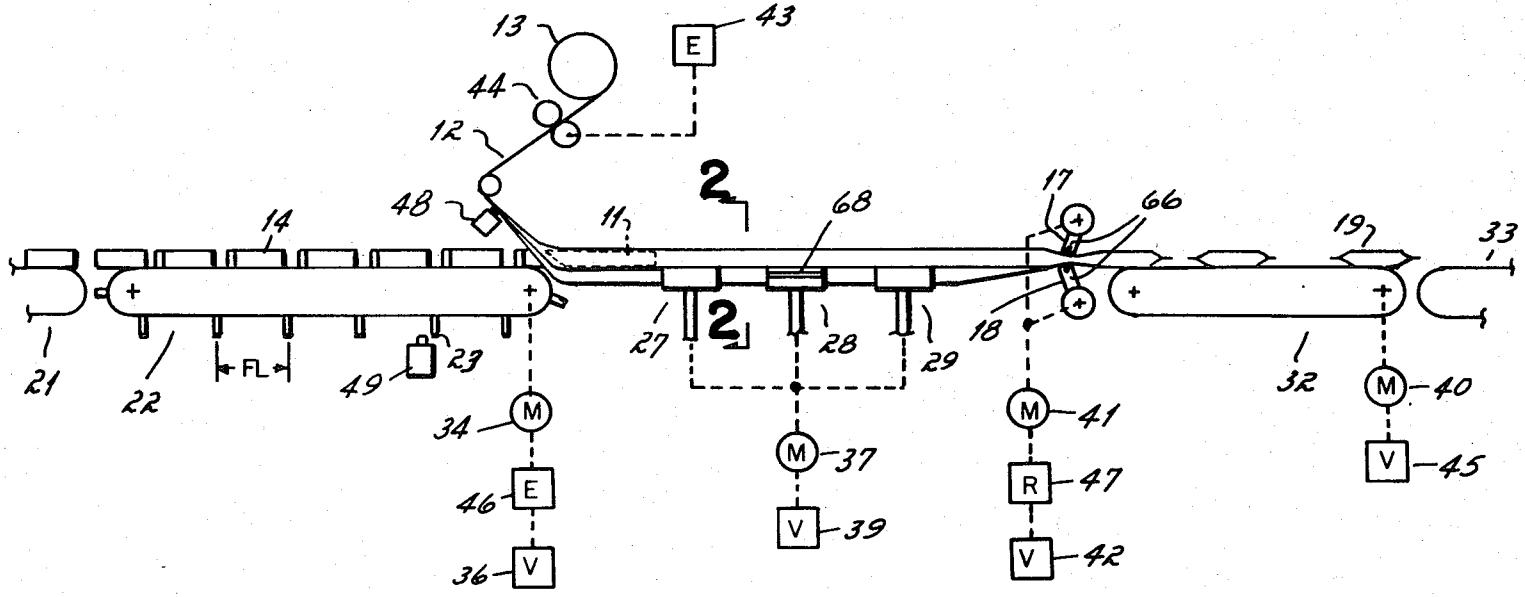
FIG. 4 is a diagrammatic side view of the horizontal wrapping machine of FIG. 1.
Figure 6:
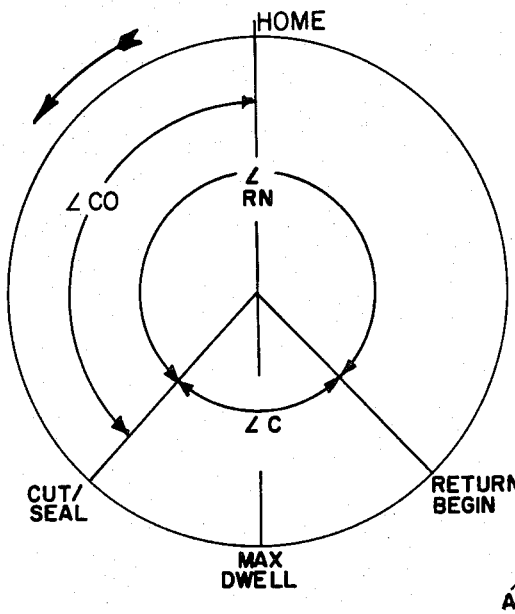
Figure 7:
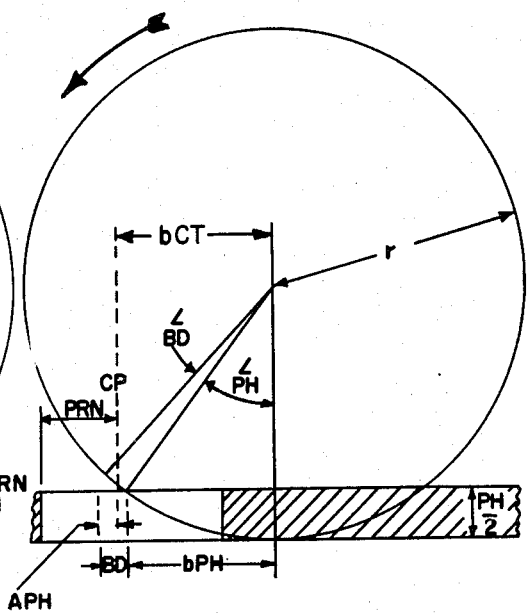
Figure 5A:
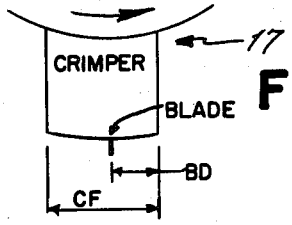
Figure 5B:
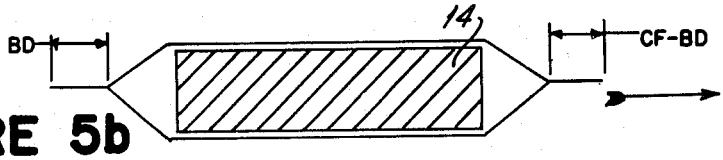
Figure 5C:
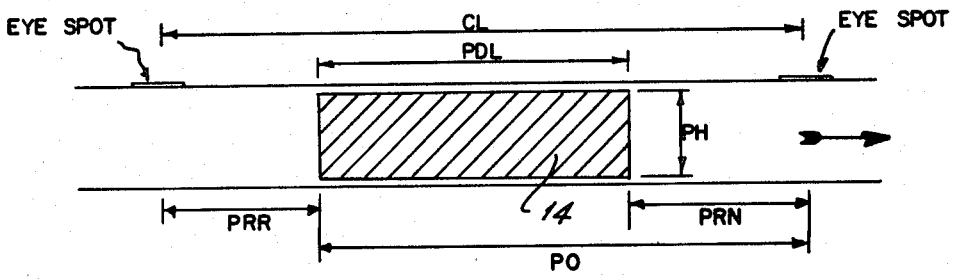
Figure 8:
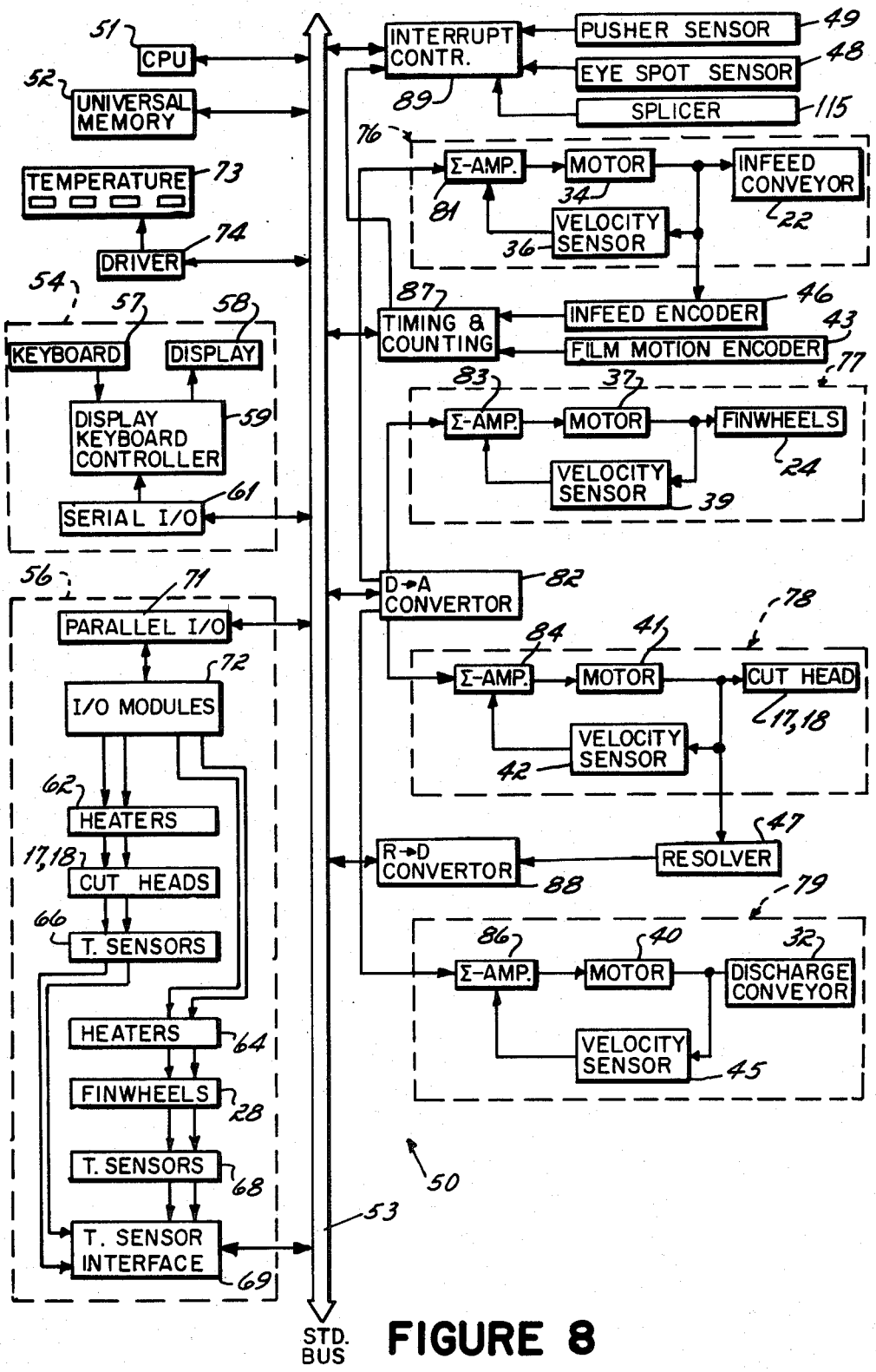
Figure 9:
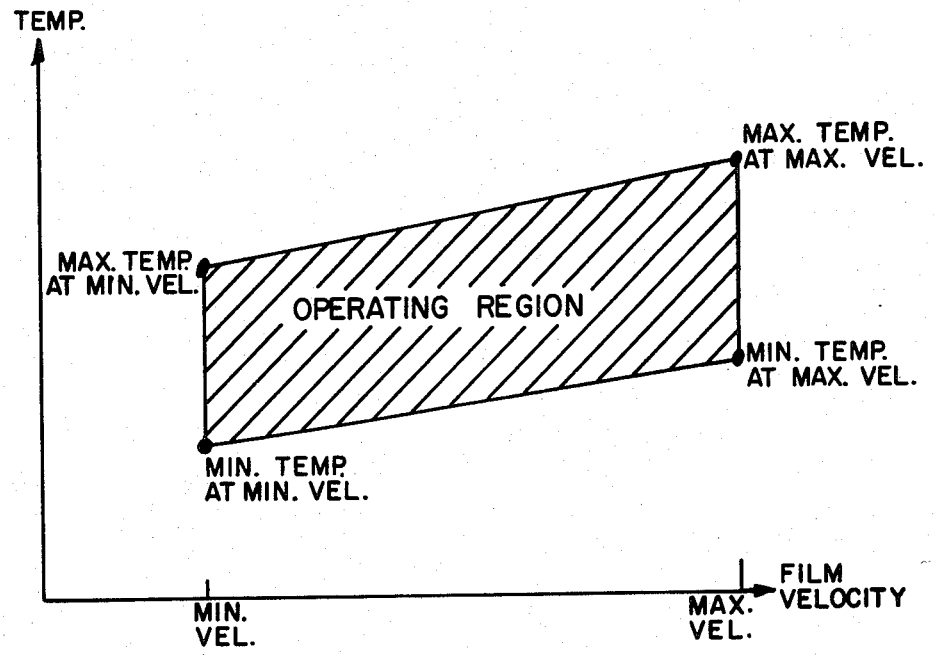
Figure 10:
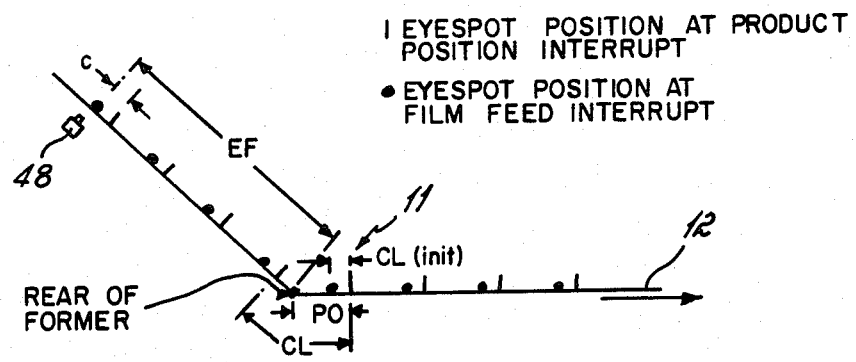
Figure 20:
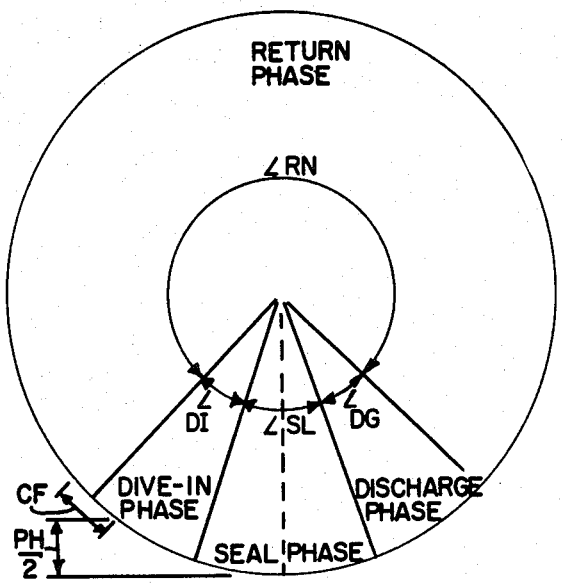
Figure 21:
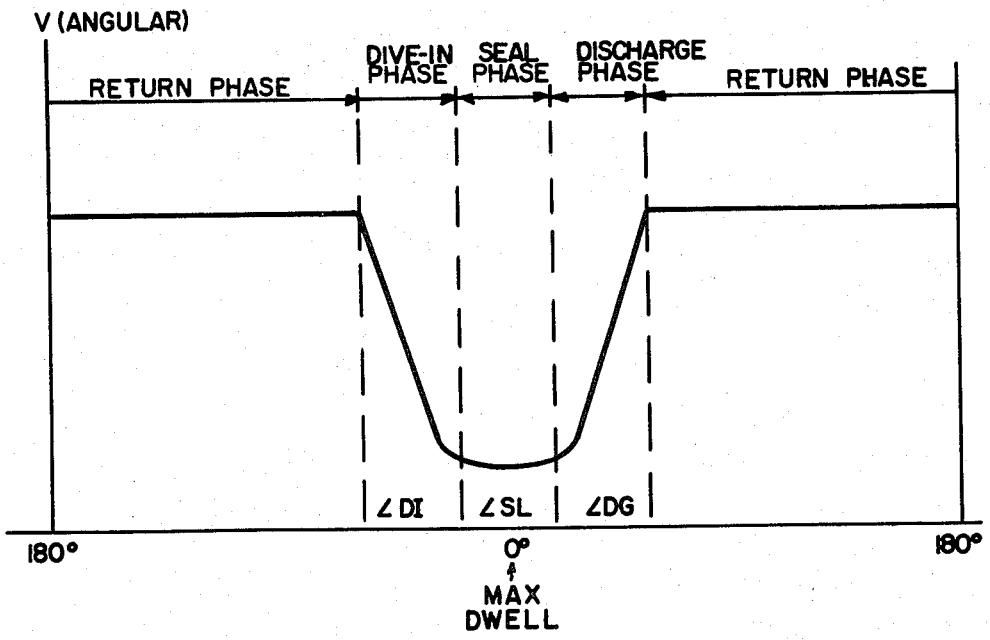

FIG. 5*a*–5*c* is a series of illustrations of a cut-head of the machine of FIG. 1 and a sealed and unsealed package produced by the machine, showing certain geometrical relationships;

FIG. 6 is an illustration of the angular length of the phases of a cut-head in the machine of FIG. 1;

FIG. 7 is an illustration of a portion of a phase of a cut-head in the machine of FIG. 1 showing certain geometrical relationships;

FIG. 8 is a hardware block diagram of the controller for the machine of FIG. 1;

FIG. 9 is a diagrammatic illustration of the temperature-film velocity operating region for the heated sealing elements of the machine of FIG. 1;

FIG. 10 is a diagrammatic illustration of film positions at the film former of the machine of FIG. 1;

FIGS. 11–19 are flow charts illustrative of the operation of the microprocessor in the control system of FIG. 8;

FIG. 20 is an illustration of the angular lengths of the phases of a cut-head in a modified form of the invention; and FIG. 21 is a cut-head velocity profile for the cut-head phases illustrated in FIG. 20.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

Referring now to the figures, and in particular to FIGS. 1–4 initially, a horizontal wrapping machine 10 includes a former 11 for shaping a continuous film 12 of packaging material which is drawn past the former 11 from a roll 13. Products 14 to be wrapped are fed into the former 11 and carried within the packaging film tube 16 formed by the former 11. The products 14 are carried within the tube 16 spaced apart from one another past a sealing and cutting station at which a pair of opposed sealing and cutting heads 17, 18 cut and seal the film tube as each product moves past the cutting and sealing station to form discrete sealed product packages 19.

In order to supply the products 14 to the film former 11, the products are received from a suitable supply source 21 on an endless conveyor 22 divided into a series of flights by a number of product pushers 23. Each product 14 is carried in a flight on the conveyor with its trailing end resting against a pusher 23.

Figure 2:
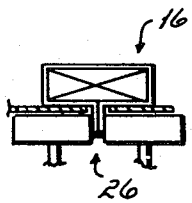
FIG. 2 is a cross-sectional view of the machine of FIG. 1 taken along the line 2—2 in FIG. 4.

The products 14 are introduced into the interior of the tube 16 of film formed by the former 11 by advancing the products 14 into the former. Each product is then received on, and carried along by, the interior bottom surface of the film tube 16. The film tube 16 is formed in a generally rectangular shape, having its two edge portions formed into downwardly extending strips. The film is driven by a suitable drive arrangement such as a finwheel or a band sealer. In the present instance, a finwheel assembly 24 advances the film tube 16 toward the cut-heads 17, 18 by gripping the downwardly extending adjacent pair of film strips, indicated generally as 26 (FIG. 2). To do this, the finwheel assembly 24 includes three pairs of opposed finwheels 27, 28 and 29. Each finwheel in each pair of finwheels rotates in an opposite direction, firmly gripping the film strips 26 therebetween, moving the film tube 16 toward the cut-heads 17, 18. The middle pair of finwheels 28 are heated to seal the strips of film 26 together to close the film tube 16.

The now-sealed tube 16 containing the spaced apart products 14 is advanced by the finwheel assembly 24 past the cut-heads 17, 18. The cut-heads are rotated in opposite angular directions to meet and engage the film tube 16 after each product moves past the cutting and sealing station. The cut-heads, when in engagement with the film tube 16, move at substantially the same linear rate as the film and coact to compress the film tube together into a flattened condition.

Figure 3:
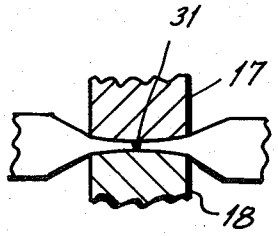
FIG. 3 is an enlarged side view of a portion of the machine of FIG. 1.

Each of the cut-heads 17, 18 are heated and the compressed film tube is sealed as it is cut, thereby enclosing each product in an enclosed, sealed package. In order to cut the sealed film to produce discrete packages, each cut-head contains a knife blade 31 extending from its film-engaging surface. The cut-head blades coact to cut the film as it is sealed (FIG. 3).

The packages 19 are carried from the cutting and sealing station by a discharge conveyor 32, which operates at a higher rate than the rate of travel of the film tube 16. The products 19 are then discharged onto a suitable receiving apparatus 33.

In order to drive the infeed conveyor 22, a motor 34 is coupled to a drive shaft of the conveyor. As shall be described in more detail hereinafter, the motor 34 is driven under closed loop servo control. The infeed conveyor actual velocity feedback signal used in the servo loop is provided by a tachometer 36 on the motor 34.

The finwheels 27, 28, 29 in the finwheel assembly 24 are likewise driven by a motor 37 which is under closed loop servo control. The individual finwheel shafts such as 38 are driven in unison through an appropriate drive arrangement by the single motor 37. As in the case of the infeed motor, the finwheel motor 37 has an associated tachometer 39 for providing an actual velocity feedback signal for the finwheel motor servo loop.

The cut-heads 17, 18 are each driven in unison by a single motor 41, which is also operated under closed loop servo control. The cut-head motor 41 has an associated tachometer 42 for providing the actual cut-head velocity feedback signal for the servo loop.

The discharge conveyor 32 is driven by a motor 40, operated under closed loop servo control. The discharge conveyor motor 40 has an associated tachometer 45 for providing the actual discharge conveyor velocity feedback signal for the servo loop.

In the illustrated horizontal wrapping machine, the infeed conveyor speed, and hence the product feed rate into the film former and film tube 16, is controlled to be dependent upon the film speed as it moves past the former and past the cutting and sealing station. In like manner, the cut-head velocities, for each of the cut-head phases (the cut phase and the return phase), are dependent upon the film velocity.

Since there may be slippage between the finwheels and the film, the film velocity is not measured at the finwheel drive. Instead, an encoder 43 is mounted on one of a pair of pinch rollers 44 through which the film passes as it leaves the roll 13. The rotation of the pinch rollers, and the production of encoder pulses by the encoder 43, are directly related to the film travel past the pinch rollers. The encoder pulses, for a given interval of time, are in turn indicative of the film velocity.

In order to measure the infeed conveyor velocity, an encoder 46 is coupled to the drive shaft of the infeed motor 34. The angular velocity of the cut-heads is derived from the output of a resolver 47 mounted on the drive shaft of the cut-head motor 41.

As noted earlier, it is important to obtain the proper orientation of each product 14 relative to a cut length of film, which is the amount of film used in each package 19. It is also important to seal and cut the tube of film 16 with the cut-heads 17, 18 at the proper cut point between the products in the film tube. The film cut lengths are defined by eye spots on the film 12. The spacing between the eye spots defines the cut lengths of the film. These eye spots are sensed by a sensor 48 to provide film position information to the control system for the horizontal wrapping machine.

A second sensor, an infeed conveyor pusher sensor 49, provides the control system with infeed conveyor position information. As shall be described, the film and product conveyor position information permits the positioning of the products 14 in the proper orientation relative to the cut lengths of film and also permits the timely operation of the cut-heads 17, 18 to seal and cut the film tube 16 at the proper cut points to form the product packages.

With reference now to FIG. 8, the controller for the horizontal wrapping machine 10 is illustrated, in conjunction with certain of the controlled elements of the machine. The controller 50 is a microprocessor-based controller including a central processing unit, or processor, 51 and a universal memory 52 coupled to a common bus 53.

The controller 50 includes an operator interface section 54 and a temperature control section 56. The operator interface section 54 includes a keyboard 57 and display 58 coupled through a display and keyboard control circuit 59 and a serial input/output circuit 61 to the bus 53. The processor 51 is operable to provide display prompts to the machine operator on the display 58 so that the operator can input desired machine operating parameters to the processor through the keyboard.

The temperature control section 56 includes circuitry for providing closed loop control of the heaters on the upper and lower cut-heads 17, 18 and the finwheels 28. The cut-heads and finwheels each contain heaters 62, 64 (not shown in FIG. 1), respectively. In addition, the cut-heads and finwheels carry temperature sensors 66 and 68, respectively.

The outputs of the temperature sensors 66, 68 are coupled through a temperature sensor interface circuit 69 to the bus 53. The processor 51 provides heater activation signals to the heaters 62, 64 by way of the bus 53 through a parallel input/output circuit 71 and a group of industrial input/output modules indicated collectively as 72. The heater activation signals are based upon the temperatures of the cut-heads and finwheels as provided by the temperature sensors 66, 68.

The temperatures of the cut-heads and finwheels are output by the processor 51 to a temperature display 73 through a driver circuit 74 which is coupled to the bus 53.

The controller 50 further includes an infeed conveyor motor servo control circuit 76, a finwheel motor servo control circuit 77, a cut-head motor servo control circuit 78 and a discharge conveyor motor servo control circuit 79. The infeed control circuit 76 includes a summer-amplifier 81 which receives a desired infeed velocity signal from the processor 51 via the bus 53 and a digital-to-analog converter 82. As previously described, the feedback loop from the motor to the summer-amplifier is completed by a velocity sensor, or tachometer, 36 which provides an actual infeed velocity signal to the summer-amplifier 81. Similarly, the finwheel servo circuit 77 includes a summer-amplifier 83 which receives a desired finwheel velocity signal from the processor via the digital-to-analog converter 82. The feedback loop is completed by the tachometer 39 which couples the finwheel motor speed to the summer-amplifier 83.

The cut-head motor servo control circuit 78 includes a summer-amplifier 84, which receives a desired cut-head velocity signal from the processor via the digital-to-analog converter 82. The cut-head servo loop is completed by the tachometer 42 which is coupled to the summer-amplifier 84.

The discharge conveyor servo circuit 79 includes a summer-amplifier 86, which receives a desired discharge conveyor motor velocity signal from the processor 51 by way of the digital-to-analog converter 82. The discharge conveyor servo loop is completed by the tachometer 45 which is coupled from the discharge conveyor motor output to the summer-amplifier 86.

The infeed encoder 46 indicative of infeed conveyor travel is coupled through a timing and counting circuit 87 and the bus 53 to the processor 51. The timing and counting circuit 87 includes a number of counters, registers and comparators for storing and comparing encoder counts, as shall be described hereinafter. The film motion encoder 43 indicative of film travel is also coupled through the timing and counting circuit 87 to the processor 51. The cut-head position sensor, the resolver 47, is coupled to the processor through a resolver-to-digital converter circuit 88 via the bus 53.

The eye spot sensor 48 for detecting eye spots on the film 12 is coupled to an interrupt controller circuit 89 as is the pusher sensor 49 which senses the pushers on the infeed conveyor. The interrupt control circuit 89 also receives a film splice signal from a film splicer 115. The interrupt control circuit 89 produces hardware interrupt signals to the processor via the bus 53 when the eye spot sensor senses an eye spot on the film, when the pusher sensor 49 senses a pusher on the infeed conveyor at the pusher sensor location, and when a new roll of film has been spliced onto the end of a previous roll by the splicer 115.

The hardware interrupt control circuit 89 is also coupled to the timing and counting circuit 87. The interrupt signals for various timed interrupt routines, to be described hereinafter, are produced by the circuit 89 in response to timing signals received from the timing and counting circuit 87. As shall also be described hereinafter, other interrupt routines are initiated based upon values in counters in the circuit 87 which are coupled to the film motion encoder 43 and the infeed encoder 46. These interrupt routines are initiated by the interrupt control circuit 89 in response to signals from the timing and counting circuit 87.

The primary function for the controller 50 in the operation of the horizontal wrapping machine 10 is to maintain proper product/film flow. The control problem may be considered to be two distinct sub-problems. The first is the verification that each product is oriented properly with respect to the eye spots on the film (product orientation). The second sub-problem is the verification that each cut is oriented properly with respect to the eye spots (cut orientation). The three motors, infeed, finwheel and cut-head, must be synchronized in order to provide these two necessary orientations to properly package a product. In the present system, the film travel is used as the master input to control the synchronization of the product infeed and the cut-head movement.

With reference to FIGS. **5*b* and 5*c*, which illustrate a sealed and unsealed packaged product, respectively, the cut length, the length of film for each package, is designated CL. For proper packaging, one product 14** must be supplied from the infeed conveyor for each cut length of film passing past the former. In the present description, each cut length CL shall be defined as extending from eye spot to eye spot on the film. Other film registrations are possible, such as the case in which each cut length begins at the midpoint between eye spots. Film registrations other than that discussed herein (eye spot to eye spot) may be readily accommodated by utilizing an appropriate offset term for the location of the cut lengths relative to the eye spots. In the absence of eye spots, the processor sets each cut length equal to an operator-entered value.

In order to supply one product 14 per cut length CL of the film requires a movement of the infeed conveyor 22 a distance of one flight length FL (FIG. 4) since there is one product per flight on the infeed conveyor. Therefore, the infeed conveyor must advance one flight length FL in the same amount of time as the film advances one cut length CL. Therefore, defining the surface velocity of the infeed conveyor as the infeed velocity IV and the film velocity as FV, the following equations hold for proper product/film flow:

$$FL = IV \times t \quad (1)$$

$$CL = FV \times t \quad (2)$$

$$FL/IV = CL/FV \quad (3)$$

$$FL/CL=IV/FV. \quad (4)$$

As stated in Equation (4), for proper product/film flow, the ratio of the infeed velocity IV to the film velocity FV must equal the ratio of the flight length FL to the cut length CL for each flight length and cut length to be matched at the film former. Ignoring product orientation problems for the moment, if the relationships of Equation (4) are maintained, the product and film flow will be properly coordinated.

Since there are variances in the distance between pushers on the infeed conveyor, it is necessary for the processor to maintain a queue of the flights that are presently in the system. This flight queue is updated by reading the infeed encoder 46 when a pusher is sensed by the sensor 49. Similarly, since the distance between eye spots on the film can vary, it is necessary for the processor to maintain a queue of cut lengths that are presently in the system. In practice, two queues of cut lengths are maintained. A first queue is designated a film/product queue and the second queue is designated a film/cut-head queue. The cut length queues are updated by reading the encoder 43 when an eye spot is sensed by the sensor 48. The updating of the queues is performed on an interrupt basis.

As mentioned earlier, the film velocity is the master parameter for the present system. A desired linear film velocity FV is determined as a function of two operator inputs: the package rate PR and the cut length CL. The package rate is the nominal desired rate for packaged products to be output from the cut-heads 17, 18. The desired film velocity is determined from the following equation:

$$FV=PR\times avg.\ CL. \quad (5)$$

The average cut length is the average value of the cut lengths in the initial film/cut-head queue. This averages out variations in cut lengths due to variations in the eye spot positions on the film. As is apparent from Equation (5), as the cut length of a package increases, the film velocity must increase if the same package rate is to be maintained. Similarly, the wrapping machine can maintain a given packaging rate for smaller packages with a lower film velocity. Once the operator has entered a package rate, and the desired film velocity FV has been determined in accordance with Equation (5), this desired film velocity will be used to derive the desired velocities for the controlled motors in the wrapping machine.

The desired film velocity serves to provide the desired velocity output to the summer-amplifier 83 in the finwheel servo loop 77. The actual desired finwheel motor speed is determined from the desired film velocity taking into account the mechanical and geometrical parameters of the finwheel drive and the finwheels. The surface velocities of the finwheels are established equal to the desired film velocity. The finwheels are thus driven so as to maintain the desired film velocity. In practice, the desired film velocity FV can be adjusted to compensate for slippage across the finwheels before the desired velocity is output to the finwheel servo loop.

The desired velocity signals for the infeed and cut-head servo loops are dependent upon the film velocity, and also upon the flight length and cut lengths which are active at any given time in the operation of the wrapping machine. The active flight length and the active cut length in the film/product queue are those lengths presently at the film former. The active cut length in the film/cut-head queue is the cut length currently at the cut-heads. Since these lengths may vary, they must be maintained in queues for use in making the necessary controlled velocity calculations.

Figure 12:
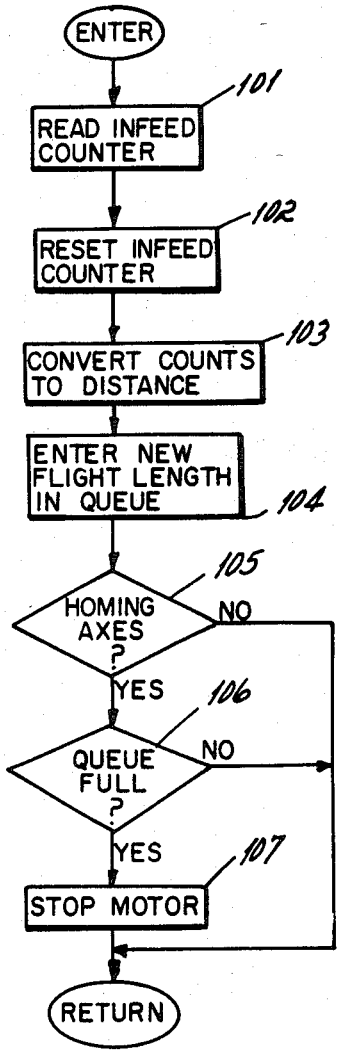

In order to update the flight queue, the processor executes an infeed interrupt routine illustrated in the flow chart of FIG. 12. When the pusher sensor 49 senses the presence of a pusher 23, the interrupt control circuit 89 provides a hardware interrupt to the processor. The processor then enters the infeed interrupt routine and reads an infeed counter (101) in the timing and counting circuit 87. The infeed counter is incremented by the infeed encoder 46 as the infeed conveyor is driven by the motor 34. The processor then resets the infeed counter to zero (102) and converts the number of counts from the infeed counter to a distance value (103). This distance value is equal to the new flight length and this new flight length is entered in the flight queue (104).

The processor next determines if the controller is in the process of homing the axes of the infeed, film, and cut-heads (105). If not, the processor returns from the infeed interrupt routine.

Homing the infeed axis comprises filling the flight queue and stopping the infeed conveyor with a pusher at the sensor 49. Therefore, if the controller is homing axes, the processor next determines if the flight queue is full (106). If not, the processor returns from the infeed interrupt routine. If the flight queue is full, the processor stops the infeed motor (107) so that the pusher sensed by the sensor 49 remains at the sensor location. The processor then returns from the infeed interrupt routine.

Figure 13:
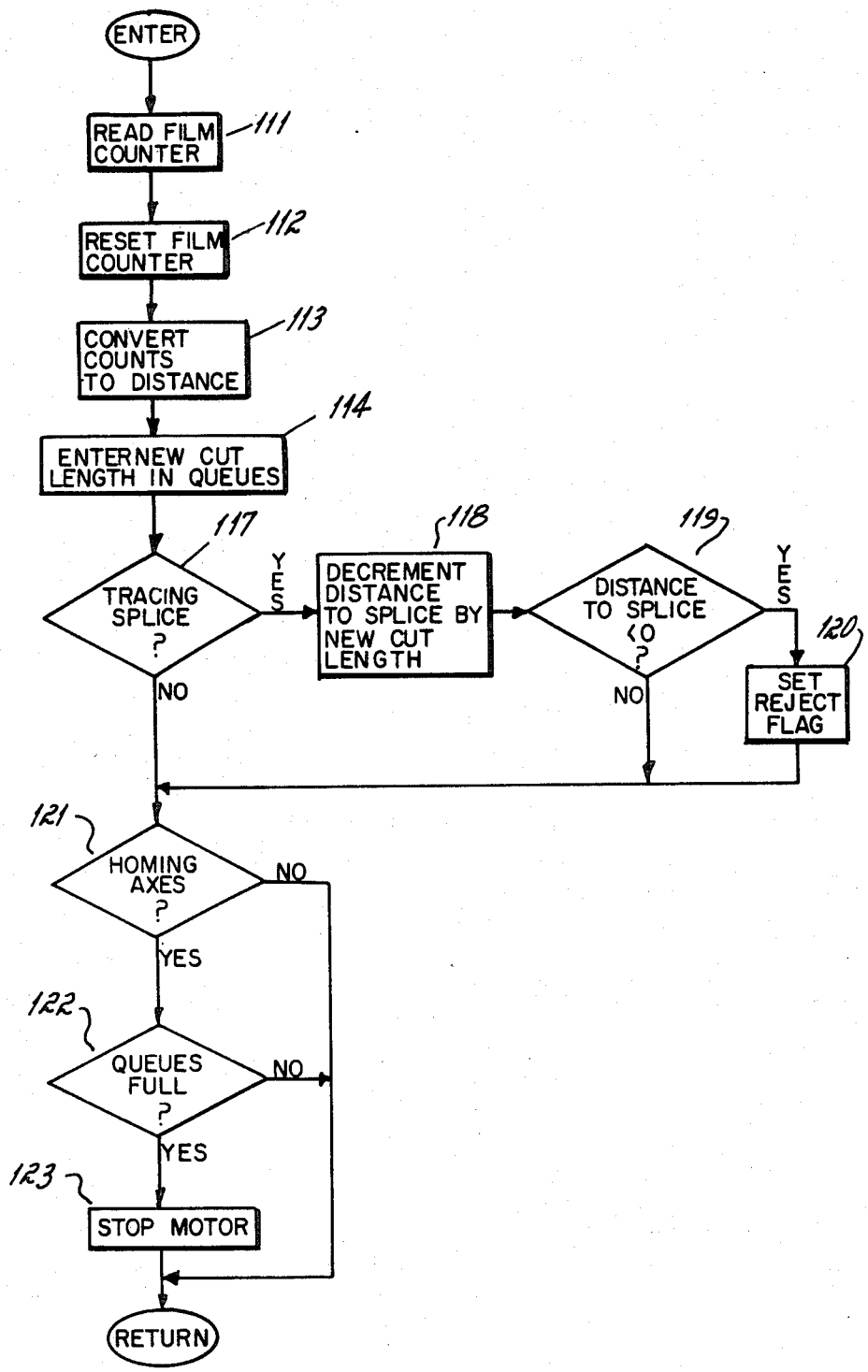

In order to fill the cut length queues, the processor executes a film feed interrupt routine as illustrated in FIG. 13. The processor enters the routine when the eye spot sensor 48 senses an eye spot, outputting a signal to the interrupt control circuit 89, which in turn produces a hardware interrupt. Upon entering the film feed interrupt routine, the processor first reads a film counter (111) in the timing and counting circuit 87. The film counter receives encoder pulses from the film motion encoder 43, and therefore, the film counter value corresponds to film travel.

After reading the film counter, the processor then resets the film counter to zero (112). The processor converts the number of counts in the counter to a distance (113) which is equal to the film travel since the last eye spot, which is the new cut length. The processor enters this new cut length into both the film/product queue and the film/cut-head queue (114). As shall be seen, the film/product queue is used to coordinate the placement of products in the film tube 16 with the proper orientation relative to each cut length. The film/cut-head queue is used to coordinate the cut points on the film with the film cut lengths.

The processor then determines if the controller is tracing a splice from a splicer at the film feed roll 13 location. Film splicers are used to automatically replace a used film roll with a new roll of film, splicing the trailing end of the old roll onto the leading end of the new roll. Typically, the film length between the last eye spot on the old film roll and the first eye spot on the new film roll will not be equal to a cut length. In addition, this spliced length of film will not contain the desired printing for a package, and it will contain a film overlap.

When a splice is made, the splicer 115 (FIG. 8) outputs a signal to the interrupt control circuit 89 which produces a hardware interrupt to the processor. The processor then enters a splicer interrupt routine (FIG. 14) and initializes a distance-to-splice register (116) and sets a flag indicating that a splice is being traced. The distance entered in the distance-to-splice register is the distance from the splice location to the eye spot sensor 48. The processor then returns from the splicer interrupt routine.

Returning to the film feed interrupt routine, after the processor has entered the new cut length in the cut length queues, the processor determines if the tracing splice flag has previously been set (117). If so, the processor decrements the distance-to-splice register by the amount of the new cut length (118). If this reduces the value in the distance-to-splice register to less than zero (119), this means that the new cut length contains the splice. If this is true, the processor sets a reject flag for this cut length (120) which will ultimately identify the package produced from the cut length as a reject package.

If the distance-to-splice register has not been decremented to a value less than zero, or if the processor is not tracing a splice, the processor next determines if the controller is in the process of homing the axes (121). The axis for the film feed is homed when both of the cut length queues are full and an eye spot is located at the eye spot sensor 48. If the controller is not homing axes, the processor returns from the film feed interrupt routine. If the controller is homing the axes, the processor determines if both of the cut length queues are full (122). If not, the processor returns from the film feed interrupt routine. If both of the queues are full, the processor stops the finwheel motor (123) and returns from the film feed interrupt routine.

The infeed, cut-head, and discharge conveyor velocities are periodically updated at timed intervals in a timed interrupt routine. In the present system, on an internally timed interrupt basis, the processor enters the timed interrupt routine (FIG. 15) every ten milliseconds. Upon entering the routine, the processor first determines if the machine is running (131). If the wrapping machine is not in operation, the processor returns from the routine. If the machine is running, the processor reads and saves the values in a cumulative film counter and a cumulative infeed counter in the timing and counting circuit 87. The cumulative film and infeed counters are separate from the counters used to establish the queues in the infeed and film feed interrupt routines. In addition to reading and saving the values in the cumulative film and infeed counters, the processor also reads and saves the angular position value of the cut-head resolver 47 via the bus 53 and the resolver-to-digital converter 88 (132). The processor then calculates the actual film velocity and product rate for the just-completed ten millisecond interval. In order to perform this calculation, as well as subsequent calculations in the routine, the processor utilizes the counter and resolver values which it has read and saved during the previous ten millisecond interrupt.

The processor converts the difference in counter values between the last ten millisecond interrupt and the present ten millisecond interrupt to a film travel length. The actual film velocity for the previous ten milliseconds is then determined by dividing this film travel by ten milliseconds. This actual film velocity is then used to determine the current actual package rate using the following formula:

$$\text{actual PR} = \text{actual FV}/\text{active CL}. \tag{6}$$

The active cut length CL is the cut length presently at the film former. This cut length, as shall be seen, is used to determine the current infeed rate. Therefore, dividing the actual film velocity by the active cut length yields the true current actual packaging rate for the wrapping machine.

The processor next determines if the calculated actual product rate is between 50 percent and 120 percent of the operator-entered desired product rate (134). If not, the processor issues an emergency stop command, stopping the machine (135). For example, if the product rate is below 50 percent of the entered desired product rate, the film may have broken. If the product rate is above 120 percent of the entered rate, some type of film drive runaway condition may have occurred.

If the actual product rate lies between the acceptable limits, the processor then determines if the product rate is being increased or decreased (136). For example, the operator may have entered a higher product rate than that at which the machine is currently operating. If such a product rate is entered by the operator, the processor sets a flag that the film speed is to be increased in order to increase the product rate. Rather than attempting to abruptly increase the film speed, risking film breakage, the processor updates the desired product rate each time the timed interrupt routine is executed until the new desired product rate is achieved (137). For example, in the present instance, the processor increases the package rate by one package per minute each time the ten millisecond interrupt routine is executed. The processor then calculates and outputs to the summer-amplifier 83 in the finwheel servo loop 77 a new desired film velocity (138).

If the package rate is not being changed, and no adjustment is being made to the desired film velocity, then the next film velocity (the film velocity for the next ten millisecond interval) is equal to the actual film velocity (139) as calculated in the step 133.

The linear velocity of the infeed IV must remain synchronized with the linear velocity of the film in order to ensure that each product is inserted into the film tube at the proper position of the film. The relationship between the linear film velocity and the linear infeed velocity is the ratio of the cut-off length to the flight length, as set forth above in Equation (4). During each ten millisecond interval, the processor uses the incremental difference in the infeed counter values from the last interrupt and the present interrupt as read in the step 132, to calculate the error in infeed travel. The calculated error is then added to the desired infeed conveyor travel for the next ten millisecond interval. This distance is converted to a velocity and output to the infeed motor control loop.

The infeed error is determined using the following equations:

$$\textit{expected IV} = \textit{actual PR} \times \textit{active FL} \tag{7}$$

$$\textit{expected IT} = \textit{expected IV} \times \textit{tINT} + \textit{previous error} \tag{8}$$

$$\textit{present ERROR} = \textit{counter change} - \textit{expected IT}. \tag{9}$$

In Equation (7), the expected infeed velocity for the previous ten millisecond interval is calculated as the product of the actual package rate (as determined in the step 133, and possibly updated in the step 137) and the active flight length FL. The active flight length is the infeed conveyor flight presently at the film former. The expected infeed travel is calculated in accordance with Equation (8) to be equal to the expected infeed velocity from Equation (7) multiplied by the ten millisecond interrupt interval plus the error which had been determined in the previous ten millisecond interrupt routine.

The present infeed error is then determined in Equation (9) to be equal to the change in infeed position as determined from the present and previous infeed counter readings from the step 132, minus the expected infeed travel from Equation (8). In essence, the present infeed error is determined as the difference between the distance the infeed conveyor actually travelled during the previous ten milliseconds and the distance the infeed conveyor was expected to travel. This infeed travel error is stored to be used as the "previous error" in the next ten millisecond interrupt routine.

The desired infeed velocity for the next ten millisecond interval is then calculated using the infeed error determined in accordance with Equation (9), to complete the step 140. In order to determine the next desired infeed velocity, the following two equations are used:

$$next\ IT = next\ PR \times active\ FL \times tINT - present\ ERROR \quad (10)$$

$$next\ IV = next\ IT / tINT. \quad (11)$$

In Equation (10), the infeed conveyor travel for the next ten milliseconds is calculated as the product of the next package rate and the active flight length multiplied by the ten millisecond interrupt interval, minus the infeed error calculated in accordance with Equation (9). The next package rate is the actual package rate either as calculated in the step 133 or as updated in the step 137. In accordance with Equation (11), the next infeed velocity is determined as the next infeed travel IT from Equation (10) divided by the ten millisecond interrupt interval.

After the next infeed velocity has been calculated, the processor outputs this next infeed velocity as the desired velocity to the summer-amplifier 81 in the infeed servo loop 76 (141). As in the case of the desired velocity output to the finwheel control loop, the desired infeed velocity must be scaled to account for the motor drive characteristics and the geometry of the infeed conveyor. The accommodation of such scaling considerations shall be assumed hereinafter with regard to the other desired velocity output signals such as those for the cut-head servo loop.

The processor next calculates and outputs the discharge conveyor desired velocity for the next ten millisecond interval (142). This desired discharge conveyor velocity is output to the summer-amplifier 86 in the discharge conveyor servo loop 79. The desired discharge conveyor velocity is determined as a constant times the next film velocity (from either the step 138 or the step 139), where the constant is greater than 1.

The processor next determines whether the cut-head is in the cut phase or the return phase of its operation (143). In the cut phase, the film-engaging surfaces of the cut-heads must move at a surface velocity substantially equal to the film velocity. During the return phase, the cut-heads must be rotated through a return angle in order to be in proper position at the proper time to begin the next cut phase for performing the next cutting and sealing operation.

After determining the cut-head phase, the processor makes the appropriate calculation of cut-head velocity and outputs the desired cut-head velocity to the summer-amplifier 84 in the cut-head servo loop 78 (144). The cut-head velocity calculations for the two phases shall be described in more detail hereinafter with regard to a cut-head phase change interrupt routine wherein the calculations are made initially each time the cut-heads change phase. After outputting the desired cut-head velocity, the processor returns from the timed interrupt routine.

For each package, the controller must verify that the product orientation relative to the film cut length is within tolerance. A product position interrupt counter driven by the infeed encoder 46 is used to initiate the routine to perform this verification each time a pusher is in position to release a product to the film tube at the former. The product position interrupt counter is set to interrupt after an incremental move of the encoder 46 equal to the distance of the next flight length in the infeed queue.

Upon entering the routine (FIG. 16), the processor first reads a cumulative film counter (151), which may be the film counter used in the timed interrupt routine, in the timing and counting circuit 87, which is coupled to the film motion encoder 43. The processor then calculates the film position error (152). This film position error is the difference between the actual film position when a product pusher is at the former and the desired film position necessary in order to obtain the desired product orientation relative to the film cut length.

With reference to FIG. 5*c*, the product position relative to a cut length of film is defined by a number of terms. The product orientation PO is the distance from the leading eye spot to the trailing end of the product. The product registration PRN is the distance from the leading eye spot to the front end of the product. The rear product registration PRR is the distance from the trailing eye spot to the trailing end of the product.

The film position error at the time of the product position interrupt is determined from the following equation:

$$film\ ERROR = (EF + desired\ PO) - (CL\ queue\ sum + c). \quad (12)$$

The terms of the equation shall be defined with reference to FIG. 10. FIG. 10 is a diagrammatic representation of two film positions as the film moves past the former 11. At the time of the initiation of the product position interrupt routine, the trailing end of the product is at the rear of the former 11, and the position of the film 12 is indicated by the eye spot locations marked by lines extending perpendicular to the film 12. By definition, the actual product orientation PO is at this time the distance from the leading eye spot of the cut length CL at the former to the trailing end of the product which is at the rear of the former. The distance EF is the distance from the former to the eye spot sensor 48.

The position of the film at the last film feed interrupt is illustrated by the eye spot positions represented by dots on the drawing. The distance of travel since the film feed interrupt is determined from the counts in the film queue counter used in the film feed interrupt routine of FIG. 13. This travel distance is designated c in FIG. 9. The current film/product queue of cut lengths in the illustration contains four cut lengths, the cut length at the former 11 and the three previous cut lengths which have moved past the sensor 48.

In Equation (12), if the product is properly oriented relative to the cut length, the actual product orientation PO indicated in FIG. 9 is equal to the desired product orientation PO. In accordance with the Figure, if this is true, the desired product orientation PO plus the distance from the eye spot sensor to the former EF must be equal to the summation of the cut lengths in the film/-product queue plus the distance c that the film has travelled since the last film feed interrupt routine.

The value for product orientation PO used in Equation (12) is the desired product orientation selected by the operator. Since:

$$(CL\ queue\ sum+c)-EF=actual\ PO. \quad (13)$$

the film error may also be viewed as:

$$film\ ERROR=desired\ PO-actual\ PO. \quad (14)$$

Figure 16:
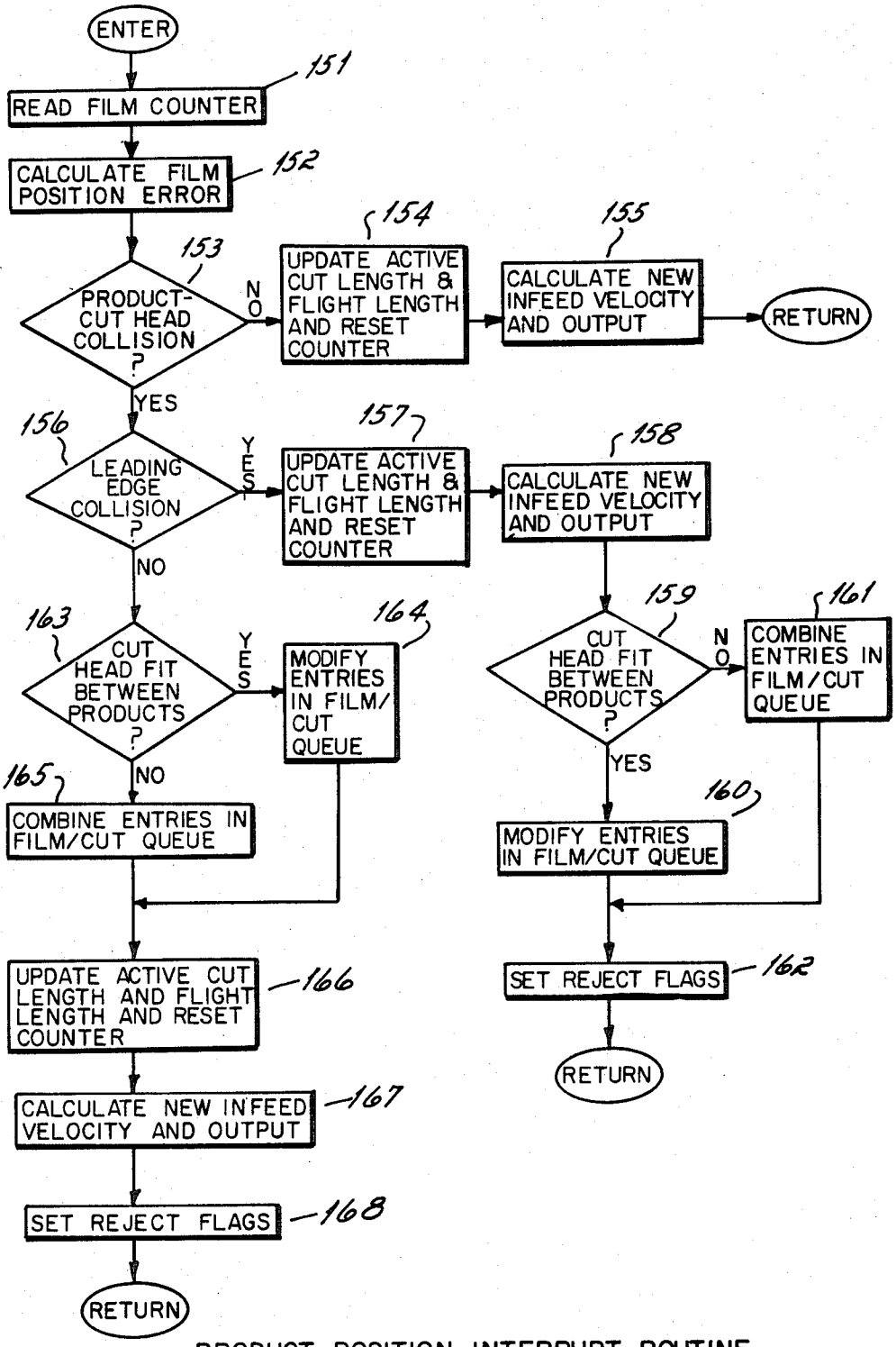

The film error which is determined in accordance with Equation (14) is used to determine if a cut-head-product collision will occur due to the product lying too close to the cut location, which in the present instance is the eye spot (the step 153 in FIG. 16). The following inequality defines the acceptable error tolerance:

$$(PRN-(CF-BD))>film\ ERROR>-(PRR-BD). \quad (15)$$

The terms in inequality (15) are defined with reference to FIGS. 5*a–c*. The product registration PRN and the rear product registration PRR have been previously discussed. CF is the length of the crimper face of the cut-head, and BD is the crimper face blade displacement from the leading edge of the crimper. The portion of the crimper face (CF−BD) must fit within the product registration length PRN in order to avoid a leading edge collision. This is expressed in the lefthand term in the inequality (15). In order to avoid a trailing edge collision, the crimper face portion BD must fit within the rear product registration length PRR. This is expressed in the righthand term of the inequality 15.

Using the inequality (15), the processor determines if a product-cut-head collision will occur. If not, the processor updates the active cut length and flight length and resets the product position interrupt counter (154). The current, or active, flight length is removed from the flight queue and the active cut length is removed from the film/product queue. The active flight length and the active cut length are saved by the processor for use in subsequent calculations. The active flight length and the active cut length are used in the product position interrupt routine, and they are also used in executing each timed interrupt routine until the next product position interrupt occurs. As shall be seen, however, the active cut length may be modified within the product position interrupt routine before it is subsequently used in order to effect correction of product-film orientation errors.

The product position interrupt counter is also reset in the step 154 to produce an interrupt after an incremental move of the infeed encoder 46 equal to the distance of the next flight in the flight length queue. At this point, the processor also saves the cut length and flight length which had been the active cut length and active flight length prior to up-dating. The processor also saves the time at which the product position interrupt routine has occurred. These parameters are used in the next ten millisecond interrupt routine to calculate the actual package rate, infeed error and next infeed velocity in two parts. One part of the calculation is for the old lengths over the portion of of the ten millisecond interval prior to the product position interrupt routine. The second part is for the remainder of the ten millisecond interval, utilizing the new active lengths.

The processor then calculates a new infeed velocity and outputs this new desired infeed velocity to the infeed servo loop (155). To do this, the processor performs the steps 140 and 141 of the timed interrupt routine of FIG. 15, utilizing the Equations (6)–(11). In the equations, zero is used in place of the ERROR term, the time since the last update is used in place of the tINT term, and the updated active flight length is used as the active flight length FL. The actual film velocity FV used is that determined during the last timed interrupt routine.

A modified active cut length for use in the calculations is determined from the following formula, wherein active CL′ denotes the modified active cut length:

$$active\ CL'=active\ CL\text{-}PO+next\ PO+film\ ERROR. \quad (16)$$

The product orientation PO in Equation (16) is the operator entered product orientation, and the next PO will be equal to PO unless the operator has entered a product orientation change. The film error term in Equation (16) is the film error calculated during the present product position interrupt routine. The use of the modified active CL, active CL′, serves to effect the requisite change in the infeed velocity to correct for the film error.

After the processor has calculated the new infeed velocity and output this desired velocity to the infeed servo loop, the processor returns from the product position interrupt routine. If, at the step 153, the processor has determined that a product-cut-head collision will occur, the processor next determines if the collision is a leading edge collision (156). If the processor determines that a leading edge collision will occur, the processor executes the steps 157 and 158 which are substantially identical to the above-described steps 154 and 155. The processor then determines if the cut-head will fit between the products (159), based upon the width of the crimper face and the spacing between the products. If the cut-head will fit between the products, the processor modifies the entries in the film/cut-head queue for the cut lengths before and after the cut point in question (160). This in effect moves the cut point, the point at which the cut-heads will be driven to engage the film. If the cut-head will not fit between the products, the processor combines the two relevant entries in the film-/cut-head queue to eliminate the cut point (161). The processor then sets reject flags for the two product packages (162) and returns from the product position interrupt routine.

If the processor has determined that a collision will occur but that it is not a leading edge collision, then the collision must be a trailing edge collision. The processor again determines if the cut-head will fit between the products (163). If so, the processor modifies the entries in the film/cut queue (164) as in the step 160. If the cut-head will not fit between the products, the processor combines the entries in the film/cut-head queue (165) as in the step 161. The processor then executes the steps 166 and 167 which are substantially identical to the steps 154 and 155 described earlier. The processor next sets reject flags for the two affected products (168) and returns from the product position interrupt routine.

Figure 17:
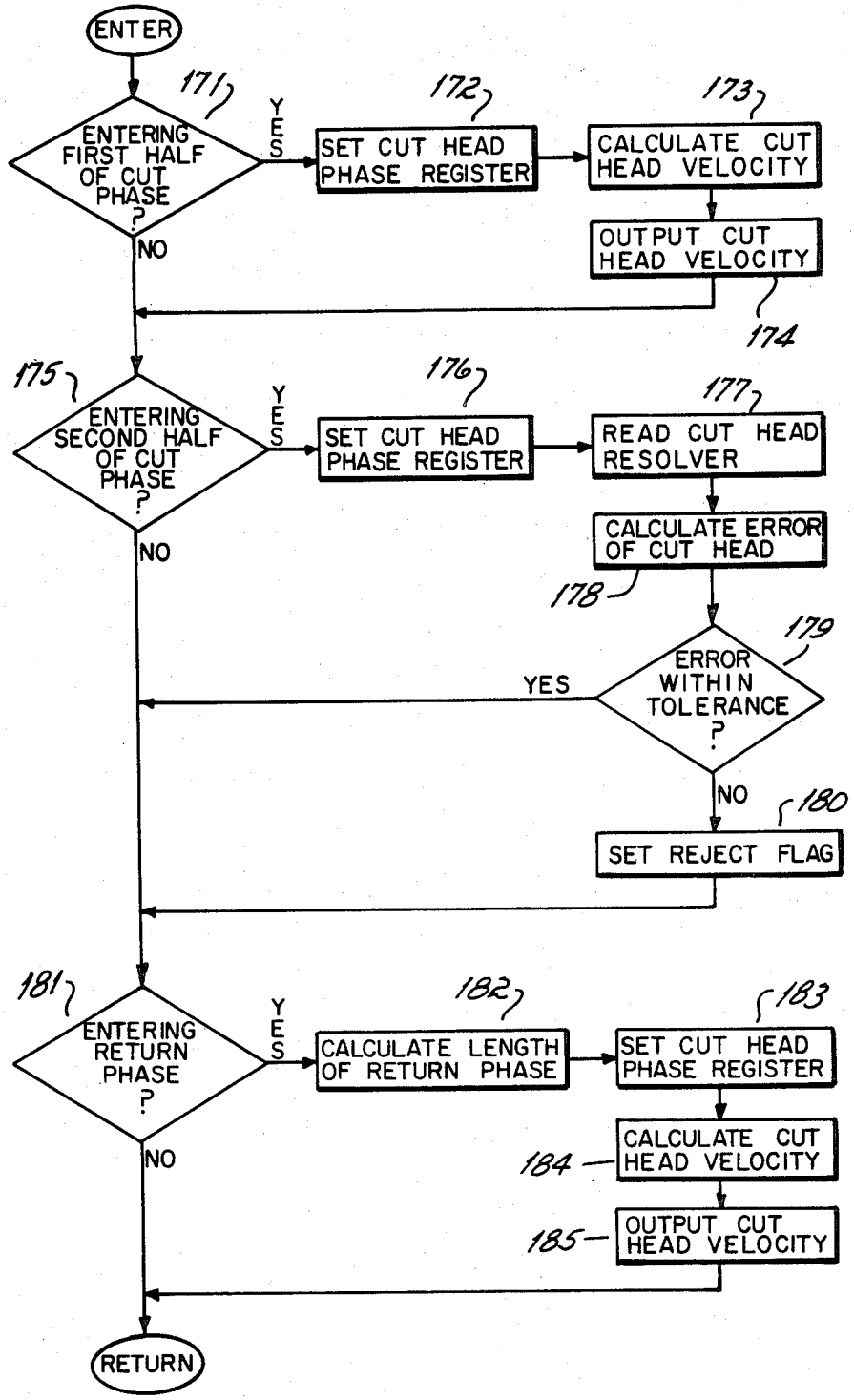
Figure 18:
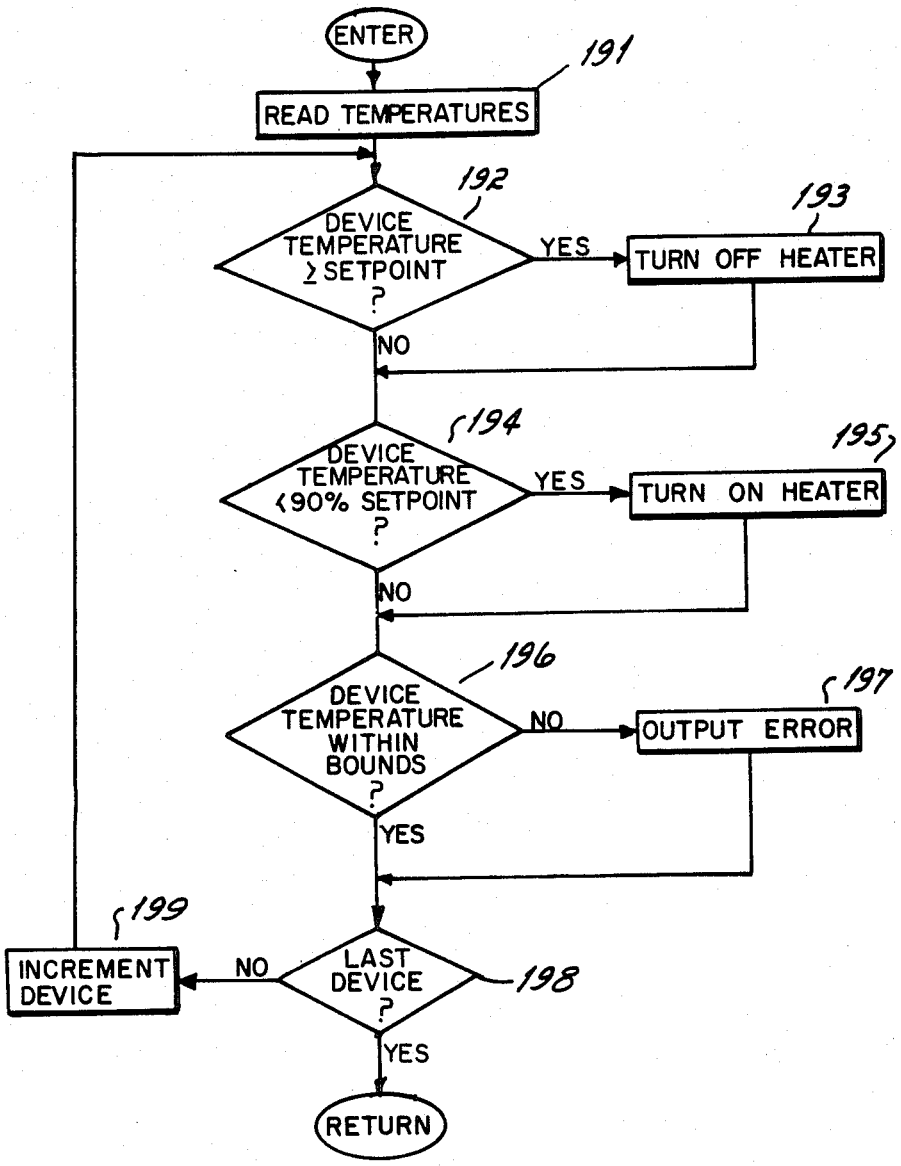

In addition to properly orienting the products relative to the film cut length, the processor also controls the rotation of the cut-heads to effect film sealing and cutting at the cut points defined by the entries in the film/cut queue. The processor maintains a cut-head phase register which contains a film position value at which the next cut-head phase is to begin. A counter coupled to the encoder pulses from the film feed encoder 43 monitors the film position. When this film position counter reaches a value equal to that set in the cut-head phase register, the cut-head phase change interrupt routine of FIG. 17 is executed.

Upon entering the cut-head phase change interrupt routine, the processor first determines if the cut-heads are entering the first half of the cut phase. With reference to FIG. 6, the first half of the cut phase extends from the cut/seal location to the maximum dwell position. The second half of the cut phase extends from the maximum dwell position to the beginning of the return phase. Together, the two halves of the cut phase extend through an angle C. The return phase extends through the angle RN, occupying the balance of one full rotation of a cut-head. The maximum dwell position is the position at which the centers of the film-engaging faces of the cut-heads are coincident.

The cut phase may be regarded as the portion of a complete rotation of each cut-head in which the cut-head crimper face is in contact with the film. The return phase may be regarded as the portion of a complete rotation of each cut-head during which the crimper face is out of contact with the film and being moved into position for the next cut.

If the cut-heads are entering the first half of the cut phase, the processor sets the cut-head phase register (172) to the film travel required to reach maximum dwell. This is substantially equal to the distance bCT shown in FIG. 7. The calculation of the distance bCT shall be described hereinafter.

The processor then calculates the cut-head velocity for the cut phase (173). During the cut phase, the surface velocity of the crimper face may be regarded as substantially equal to the film velocity, and the angular velocity of the cutter heads may be derived from this velocity based upon the radius r from the cutter head axis to the crimper face. The processor then outputs this cut-head velocity (174) to the cut-head servo loop 78.

If the cut-head is not entering the first half of the cut phase, the processor determines if the cut-head is entering the second half of the cut phase (175). If so, the processor sets the cut-head phase register for the amount of film travel necessary to reach the end of the second half of the cut phase (176). This distance is equal to the sum of the distances BD and bPH shown in FIG. 7, which shall be described subsequently.

The processor then reads the cut-head resolver 47 via the resolver-to-digital converter 88 (177). The processor then calculates the error between the actual cut-head position and the desired cut-head position (178). The desired cut-head position at the time that the cut point on the film reaches the maximum dwell location is the maximum dwell position. The difference between the actual resolver output and the resolver value for the maximum dwell position of the cut-head is the cut-head position error. The processor then determines if the cut-head position error is within a preset tolerance (179). If the error is not within tolerance, the processor sets a reject flag for the packages adjacent the cut.

If the cut-head is not entering either half of the cut phase, the processor checks to determine if the cut-head is entering the return phase (181). If so, the processor calculates the length of the return phase (182).

During the return phase, the cut-head must move through an angle RN from its position at the beginning of the return phase to the cut seal position for the next cut phase. The cut-head must move through this angle RN during the time that the film moves from its position at the beginning of the return phase to a location where the cut point for the next cut phase is in the proper position to begin the cut phase. The requisite film travel is equal to the present cut length CL at the cutting and sealing station minus the distance the film has travelled during the cut phase.

With reference to FIG. 7, the cut-head angle at the beginning of a cut phase is the sum of the angles PH and BD. The angles BD and PH may be determined from the following:

$$PH = 90° - arcsin((r - PH/2)/r) \quad (17)$$

$$BD = 90° - arccos(BD/r). \quad (18)$$

In these equations, r is the radius from the center of rotation of the cut-head to the crimper face and PH/2 is one half of the product height. The angle PH is the angle of the cut-head relative to the maximum dwell position at which the blade contacts the film due to the product height. The angle BD is the additional angle in advance of the maximum dwell position at which the crimper contacts the film due to the blade displacement on the crimper face.

The proper position for the cut point CP on the film relative to the maximum dwell position at the beginning of the cut phase is substantially equal to bPH plus BD. This distance is equal to the portion of the circumference of a circle of radius r subtended by the angle BD plus the angle PH. Since the film, upon contact by the cut-head, moves vertically as well as horizontally a product height adjustment APH is made so that the cut point CP actually lies a distance APH closer to the maximum dwell position at the beginning of the cut phase. APH is determined from the following formula:

$$APH = D - D\ cos[arcsin((PH/2)/D)], \quad (19)$$

where D is equal to: [PRN−(CF−BD)]. Therefore, the distance along the film from the maximum dwell position to the cut point location, at the time that the cut phase should begin, is equal to bPH plus BD minus APH.

Returning to the step 182 in the cut-head phase change interrupt routine, the film travel length of the return phase is equal to the distance of film travel needed to move the next cut point from its present location to the location illustrated in FIG. 7. As indicated above, this amount of film travel is equal to the present length CL minus the distance the film has travelled during the cut phase. This film travel is set in the cut-head phase register in the step 183. The angular length of the return phase is described by the Equations (17) and (18).

The processor then calculates the initial cut-head return velocity. The angular velocity during the return phase must be such that the cut-head rotates through the angle RN in the time that the film travels the distance to move the next cut point to the proper position for the next cut phase, the travel set in the cut-head phase register. The desired angular cut-head velocity for the return phase is equal to the product of the angle RN and the film velocity, divided by the film travel during the return phase. This desired cut-head velocity is calculated and then output (185) to the cut-head servo loop 78.

After performing the steps in the routine for whichever phase has been entered, the processor then returns from the cut-head phase change interrupt routine.

Figure 15:
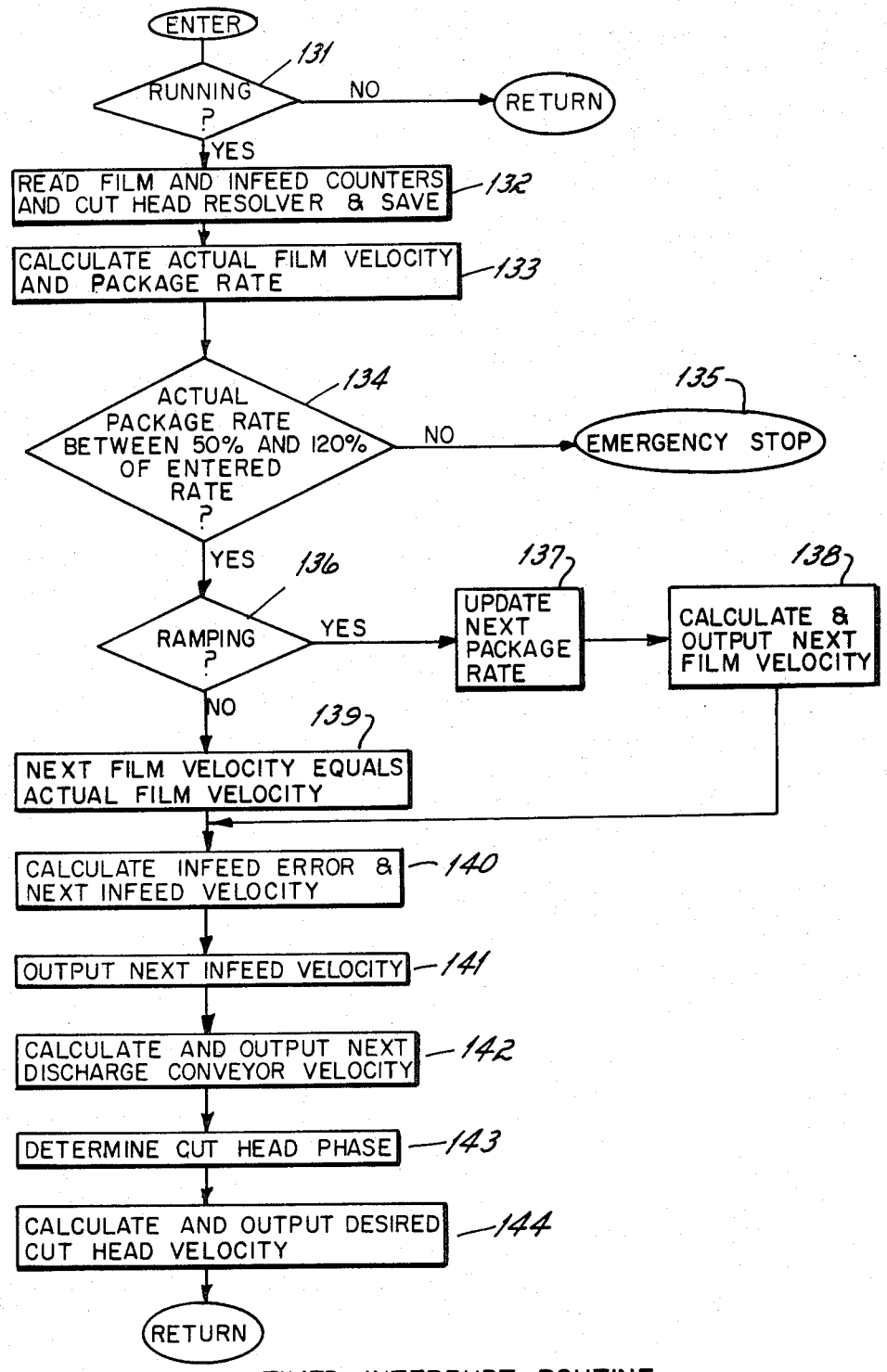

It will be recalled that the cut-head velocity is calculated and output in the step 144 of the timed interrupt routine of FIG. 15 at ten millisecond intervals. When the cut-head is in the cut phase, the crimper face surface velocity is maintained substantially equal to the film velocity. Therefore, recalculation of the cut-head velocity during the cut phase, after it is initially established, is performed merely to accommodate changes in the film velocity. During the return phase, in the timed interrupt routine, the processor monitors the remaining return angle, and the film position, and uses this information in combination with the updated film velocity to calculate an updated desired cut-head velocity each ten milliseconds during the cut-head return phase.

The processor also controls the activation of the heaters on each of the finwheels 28 and the cut-heads 17, 18. On a timed interrupt basis, such as at one half second intervals, the tempertures of these devices are monitored and the appropriate on/off signal output to each heater. As illustrated in the flow chart of FIG. 18, when the processor enters the routine, it first reads the temperatures from temperature sensors at each of the four devices. The processor then checks to determine if the temperature of the first device is greater than or equal to a setpoint temperature (192). If the device temperature is greater than or equal to the setpoint, the processor turns off the heater (193). The processor then determines if the device temperature is less than 90 percent of the setpoint temperture (194). If the device temperature is less than 90 percent of the setpoint temperature, the processor turns on the heater (195). The processor then determines if the device temperature is within the proper bounds for the film velocity at which the wrapping machine is operating (196). An exemplary proper operating region for one of the devices is illustrated in FIG. 9. As shown, the acceptable range of temperatures at higher film velocities is greater than the acceptable range of temperatures at lower film velocities. In the step 196, the processor obtains the current film velocity determined in the last timed interrupt routine and determines if the device temperature is within the acceptable range of temperatures for that film velocity.

If the device temperature is not within bounds, the processor outputs an error indication (197). After checking the device temperature, the processor then determines if the device just checked was the last device of the heated devices in the system (198). If not, the processor increments to the next device (199) and repeats the steps 192–198. When the processor has checked all of the devices, the processor then returns from the temperature interrupt routine.

Figure 11:
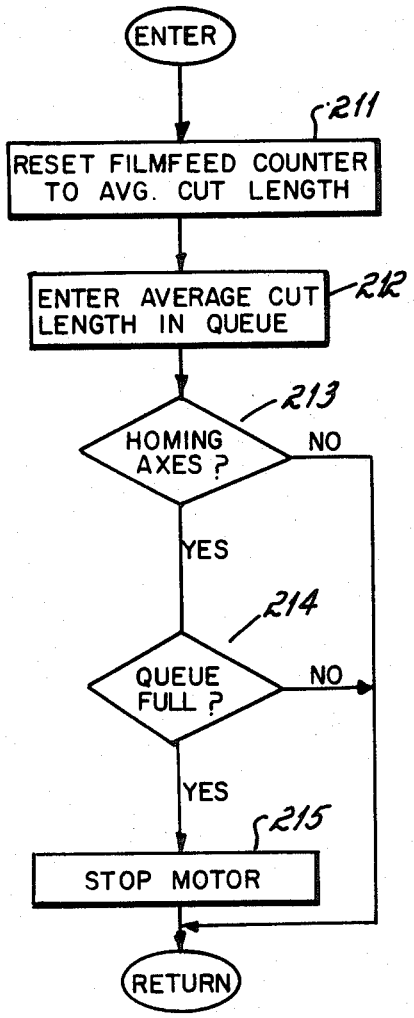
Figure 14:
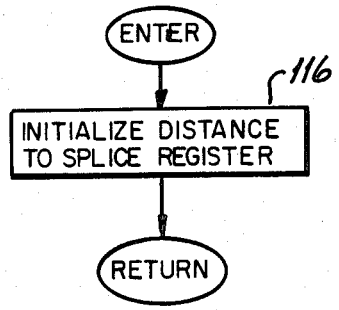

In the operation of the wrapping machine, the processor also determines if an eye spot is either missing from the film or has not been detected by the eye spot sensor. In order to do this, a compare register containing a value equal to twice an average cut length is compared to the value in the film feed counter used by the film feed interrupt routine. If the film feed counter reaches a count equal to twice an average cut length, a missed eye spot interrupt routine is executed by the processor (FIG. 11). Upon entering the routine, the processor resets the film feed counter to the average cut length (211), and then enters an average cut length in the film/product and film/cut-head queues (212). The processor then checks to determine if the axes are being homed (213). If so, and if the queues are full (214), the processor stops the finwheel motor (215). The processor then returns from the routine.

Figure 19:
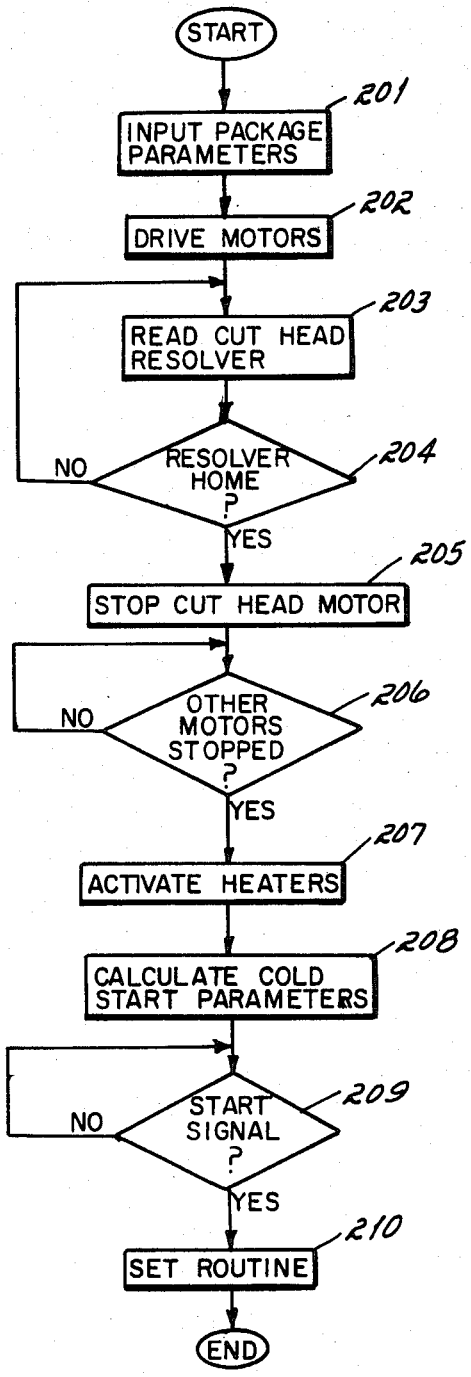

In order to initially synchronize the wrapping machine drives when the wrapping machine is started, a set-up routine is executed by the processor. Upon beginning the set-up routine, which is illustrated in FIG. 19, the processor prompts the operator to supply the necessary operator-entered package parameters for the packages to be produced (201). The operator is prompted to enter the package length, product height, product length, product registration, film registration, package rate, and the setpoint cut-off and finwheel temperatures. The processor then drives the infeed, finwheel and cut-head motors (202). The processor reads the cut-head resolver (203) and, when the resolver is at home position (204), stops the cut-head motor (205). In the present case, the resolver home position is 180° from the maximum dwell position.

During the execution of the steps 203 and 204, the other motors have been driven and the axes homed. As described earlier with regard to the infeed interrupt routine and the film feed interrupt routine, the flight lengths and cut lengths are placed in the queues, and when the queues are full, the infeed and finwheel motors are stopped. After each of the other motors have stopped (206), the processor then activates the heaters for the finwheels and the cut-heads (207).

The processor next calculates the cold start parameters for initial operation of the wrapping machine (208). The cold start parameters to be calculated are an initial cut length and an initial flight length to be used as the active cut length and active flight length in driving the infeed conveyor into synchronism with the film. In addition, an appropriate cut-head angular velocity must be derived to move the cut-head from the home position to the proper position for the first cut phase.

With reference to FIG. 10, when the film is at its home position, an eye spot is positioned at the sensor 48, as shown by the dotted eye spot positions in the Figure. The distance that the film must move initially to be at the proper position to receive a first product presented at the former is the distance indicated CL (init). This initial cut length is used as the active cut length when the wrapping machine is started.

The initial flight length is the distance from the rear of the film former to the first infeed pusher upstream from the former. This distance is equal to the distance from the flight sensor to the film former minus the sum of the flight lengths in the flight queue. This initial flight length is then used as the active flight length when the machine is started.

In order to coordinate the cut-head position with the film position at start up, the angular travel of the cut-head from the home position to the beginning of the cut phase must be determined. In addition, the necessary film travel from the home position of the film to move the film into position for the beginning of the first cut phase must be determined. As illustrated in FIG. 6, the initial angle of travel, defined as the cut orientation angle CO, is equal to one half of the return angle RN.

The distance the film must travel so that the first cut point (eye spot) is at the location for the beginning of the cut cycle is defined as the cut film orientation distance CFO. The distance CFO is determined in two steps. The first eye spot is located upstream from the cut-head maximum dwell location. Therefore, first, the distance between the leading eye spot and the maximum dwell location is determined. This distance is equal to the distance from the eye spot sensor to the cut-head maximum dwell location, minus the total of the cut lengths in the film/cut queue.

The requisite travel for the lead eye spot is not this total distance to the maximum dwell location, but rather it is the distance to the cut point CP location in FIG. 7, which is in advance of the dwell location. Therefore, the distance between CP and the maximum dwell location (bCT in FIG. 7) must be subtracted from this eye spot-to-maximum dwell location distance to obtain the cut film orientation distance CFO.

Once the cut orientation angle CO and the cut film orientation film travel CFO have been determined, the processor then waits for a start signal (209). When a start signal is received, the processor executes a set routine (210). In the set routine, the processor uses the calculated CL, FL, CO, and CFO values in the appropriate registers and to calculate and output the initial set of desired velocity signals to the motor servo loops. The infeed velocity is updated subsequently in the timed interrupt routine using the initial cut length and flight length as the active cut length and flight length. The timed interrupt routine also updates the desired cut-head velocity in the same manner as during the cut-head return phase.

While a number of priorities may be assigned to the processor interrupt routines, in the present system the routines, in descending order or priority, are: the splicer interrupt routine, the product position interrupt routine, the cut-head phase change interrupt routine, the timed interrupt routine, the film feed interrupt routine, the missed eye spot interrupt routine, the infeed interrupt routine, and the temperature interrupt routine. The principal background activity of the processor is to recognize and process operator entries and update the displays.

It will be appreciated that other routines may be employed for operating the microprocessor-based controller for the illustrated horizontal wrapping machine without departing from the spirit and scope of the invention. For example, the timed interrupt routine (FIG. 15) may be modified to calculate a new desired infeed velocity on a prospective rather than a retrospective basis in the step 140 of the timed interrupt routine.

In order to do this, the processor in the timed interrupt routine, every ten milliseconds in the illustrated system, does not adjust the desired infeed velocity based upon the error in how far the infeed conveyor should have travelled in the previous ten milliseconds. Instead, in each execution of the ten millisecond interrupt routine, the processor derives a desired infeed velocity based upon the actual film velocity and the remaining infeed travel and film travel necessary to place the active flight length FL and the active cut length CL in proper orientation at the former. The requisite infeed travel is the distance the infeed conveyor must move to initiate the next product position interrupt routine, which occurs when the next product is presented at the former. The requisite film travel is that required to place the current active cut length of film in the proper position at the former when the product position interrupt routine is next activated. The modified calculation of the next infeed velocity, in place of the calculation described for the step 140 in the timed interrupt routine illustrated in FIG. 15, is defined by the following equations:

$$\text{next } IV = \text{remaining } FL \times \text{actual } FV / \text{remaining } CL \quad (20)$$

$$\text{remaining } FL = \text{active } FL - \text{product position counter} \quad (21)$$

$$\text{remaining } CL = \text{active } CL - \text{film movement counter.} \quad (22)$$

The actual film velocity FV utilized in Equation (20) is the actual film velocity determined in the step 133 of the timed interrupt routine. The active flight length FL and the active cut length CL used in the Equations (21) and (22) are those which have been determined in the most recent execution of the product position interrupt routine (the step 154 in FIG. 16).

The product position counter is the counter which measures infeed travel and is reset each time the product position interrupt routine is executed. Therefore, whenever the timed interrupt routine is executed to update the desired infeed velocity IV in accordance with Equation (20), the value in the product position counter is equal to the amount of infeed travel since the last product position interrupt. The film movement counter is an additional counter in the timing and counting circuit 87 coupled to the film motion encoder 43. The product position interrupt routine is modified so that this counter is also reset each time the product position interrupt routine is executed. The film movement counter therefore provides an indication of film travel since the last product position interrupt.

In the modified product position interrupt routine, when a product is presented at the former, the error in film position is determined in a modified step 152 by determining the remaining cut length CL in accordance with Equation (22). Since, at the time of the product position interrupt, ideally the film has moved a distance equal to the current active cut length, any non-zero result from the Equation (22) is a film position error.

The film movement counter is also used in each modified timed interrupt routine in a modified step 133 for determining the actual film velocity FV. In the modified step 133, the processor determines the actual film velocity FV based upon the difference in film travel as indicated by the change in the film movement counter, divided by the ten millisecond interrupt interval. The film movement counter is, in the modified timed interrupt routine, the film counter which is read in a modified step 132 in the timed interrupt routine.

In a further modified embodiment of the illustrated horizontal wrapping machine, the cut-head phases may be further refined. Since independent servo control for the cut-heads is provided, the cut-head angular velocity, and the corresponding crimper face surface velocity, may be profiled as desired during the time that the cut-head is in contact with the packaging film. With reference to FIGS. 20 and 21, the cut phase is divided into three parts: a dive-in phase, a seal phase, and a discharge phase. The dive-in phase is defined by the angle DI through which the cut-head rotates from initial crimper face contact with the film to the beginning of the seal phase. This angle DI is dependent upon the product height and the crimper face dimensions. The seal phase is defined by the angle SL through which the cut-head rotates from the end of the dive-in phase to the beginning of the discharge phase. This angle is centered about the maximum dwell position.

The discharge phase is defined by the angle DG through which the cut-head rotates from the end of the seal phase to a position when the crimper face is clear of the package height. The return phase is defined by the angle RN, which is the same angle for the return as defined previously. This is the angle through which the cut-head rotates from the end of the discharge phase to the beginning of the next dive-in phase. This angle is also dependent upon the package height and the crimper face dimensions.

As shown in FIG. 20, the seal phase is divided into two halves centered about the maximum dwell position. As described previously, the processor checks for angular position error at the point of maximum dwell. As also earlier described, the cut-head is driven to the particular angular positions to begin each of the illustrated phases by controlling the cut-head velocity relative to the film velocity, with the above-mentioned check for error at the maximum dwell position during each seal phase. The desired angular positions for the cut-head, and the corresponding positions for the film moving past the cut-head, are determined through geometrical calculations dependent upon the product height and the cut-head crimper face dimensions. The calculation described earlier with regard to FIG. 7 to determine the film and cut-head positions at the beginning of the cut phase are illustrative of the geometrical analysis.

The angular velocity of the cut-head follows the generally trapezoidal profile illustrated in FIG. 21. The angular velocity during the seal phase must maintain a linear component of velocity equal to the film velocity. The angular velocity during the return phase must be such that the cut-head rotates through the angle RN in the time that the film travels to locate the next cut point as shown in FIG. 7. The angular velocity during the discharge phase typically must dynamically increase from the angular velocity during the seal phase to the angular velocity for the return phase. Similarly, the angular velocity during the dive-in phase must typically dynamically decrease from the angular velocity during the return phase to the angular velocity during the seal phase.

While the invention has been described herein with regard to a preferred embodiment in which the product infeed and the film tube are moving horizontally, the practice of the invention is also susceptive to non-horizontal orientations of the product infeed and the film tube.

What is claimed is:

1. A horizontal wrapping machine for wrapping products in packages formed from a continuous film of packaging material, comprising:

a former for shaping a continuous film of packaging material drawn past the former into a continuous tube;

film drive means, responsive to a film velocity control signal, for drawing the continuous film of packaging material past the former and past a cutting and sealing station at a velocity dependent upon the film velocity control signal;

product infeed means, responsive to a product infeed velocity control signal, for feeding products to be packaged into the former and the continuous tube of packaging material at a velocity dependent upon the product infeed velocity control signal;

means for cutting and sealing the continuous tube of packaging material as each product moves past the cutting and sealing station;

means for measuring the film velocity;

means for measuring the product infeed velocity; and means for producing the film velocity control signal and the product infeed velocity control signal such that the control signal for one of said velocities is dependent upon the measured value of the other said velocity.

2. The horizontal wrapping machine of claim 1 in which the film drive means and the product infeed means are driven under closed loop servo control.

3. A method of wrapping products in packages formed from a continuous film of packaging material comprising the steps of:

shaping a continuous film of packaging material in a former by drawing the film past the former into the shape of a continuous tube;

drawing the continuous film of packaging material past the former and past a cutting and sealing station at a velocity dependent upon a film velocity control signal;

feeding products to be packaged into the former and the continuous tube of packaging material at a velocity dependent upon a product infeed velocity control signal;

cutting and sealing the continuous tube of packaging material as each product moves past the cutting and sealing station;

measuring the film velocity;

measuring the product infeed velocity; and producing the film velocity control signal and the product infeed velocity control signal such that the control signal for one of said velocities is dependent upon the measured value of the other said velocity.

4. A wrapping machine for wrapping products in packages formed from a continuous film of packaging material, comprising:

a former for shaping a continuous film of packaging material drawn past the former into a continuous tube;

film drive means, responsive to a film velocity control signal, for drawing the continuous film of packaging material past the former and past a cutting and sealing station at a velocity dependent upon the film velocity control signal;

product infeed means, responsive to a product infeed velocity control signal, for feeding products to be packaged into the former and the continuous tube of packaging material at a velocity dependent upon the product infeed velocity control signal;

means for cutting and sealing the continuous tube of packaging material as each product moves past the cutting and sealing station;

means for measuring the film velocity;

means for measuring the product infeed velocity; and means for producing the film velocity control signal and the product infeed velocity control signal such that the control signal for one of said velocities is dependent upon the measured value of the other said velocity.

5. A wrapping machine for wrapping products and packages formed from a continuous film of packaging material, comprising:

a former for shaping a continuous film of packaging material drawn past the former into a continuous tube;

film drive means for drawing the continuous film of packaging material past the former and past a cutting and sealing station;

product infeed means for feeding products to be packaged into the former and the continuous tube of packaging material;

means for cutting and sealing the continuous tube of packaging material as each product moves past the cutting and sealing station;

means for measuring at least one of said film velocity and infeed velocity; and means for controlling the other of said film velocity and infeed velocity, in response to the velocity measured by the means for measuring, by controlling the one of said film drive means and product infeed means associated with said other velocity.

6. A wrapping machine for wrapping products in packages formed from a continuous film of packaging material comprising:

a former for shaping a continuous film of packaging material drawn past the former into a continuous tube;

signal controlled film drive means for drawing the continuous film of packaging material past the former and past a cutting and sealing station;

signal controlled product infeed means for feeding products to be packaged into the former and the continuous tube of packaging material;

signal controlled cutting and sealing means for cutting and sealing the continuous tube of packaging material as each product moves past the cutting and sealing station, said film drive means, said product infeed means, and said cutting and sealing means being free of mechanical power-transmitting interconnections therebetween, whereby the speed of each can be independently controlled by control signals; and a microprocessor-based controller electrically interconnected with said film drive means, said product infeed means, and said cutting and sealing means for controlling the speed of each said means.

7. A method of wrapping products in packages formed from a continuous film of packaging material comprising the steps of:

shaping a continuous film of packaging material in a former by drawing the film past the former into the shape of a continuous tube;

drawing the continuous film of packaging material past the former and past a cutting and sealing station at a velocity dependent upon a film velocity control signal;

feeding products to be packaged into the former and the continuous tube of packaging material at a velocity dependent upon a product infeed velocity control signal;

cutting and sealing the continuous tube of packaging material as each product moves past the cutting and sealing station dependent upon a cutting and sealing control signal; and producing the film velocity control signal, the product infeed velocity control signal, and the cutting and sealing control signal utilizing a microprocessor-based controller.

* * * * *